US005418122A

United States Patent [19]

Seto et al.

[11] Patent Number: 5,418,122

[45] Date of Patent: May 23, 1995

[54] SILVER HALIDE COLOR PHOTOGRAPHIC MATERIAL

[75] Inventors: Nobuo Seto; Yasuhiro Yoshioka; Masakazu Morigaki, all of Kanagawa, Japan

[73] Assignee: Fuji Photo Film Co., Ltd., Minami Ashigara, Japan

[21] Appl. No.: 153,195

[22] Filed: Nov. 17, 1993

[30] Foreign Application Priority Data

Dec. 4, 1992 [JP] Japan ..... 4-350183

[51] Int. Cl.[6] ..... G03C 7/392; G03C 7/36

[52] U.S. Cl. ..... 430/551; 430/556; 430/557

[58] Field of Search ..... 430/551, 546, 556, 557

[56] References Cited

U.S. PATENT DOCUMENTS

| | | | |
|---|---|---|---|
| 4,252,893 | 2/1981 | Iwamuro et al. | 430/504 |
| 4,489,155 | 12/1984 | Sakanoue et al. | 430/551 |
| 4,656,125 | 4/1987 | Renner et al. | 430/551 |
| 5,190,853 | 3/1993 | Seto et al. | 430/551 |

FOREIGN PATENT DOCUMENTS

| | | | |
|---|---|---|---|
| 1067852 | 4/1986 | Japan | 430/551 |
| 2032455 | 2/1987 | Japan | 430/551 |

*Primary Examiner*—Lee C. Wright

*Attorney, Agent, or Firm*—Burns, Doane, Swecker & Mathis

[57] ABSTRACT

A silver halide color photographic material is disclosed which comprises a support having thereon at least one layer containing at least one compound of the following general formula:

wherein $R_1$ represents a hydrogen atom, an aliphatic group, —C(=O)—$R_7$, —S(=O)2—$R_8$ or —P(=O)($R_7$)($R_9$); $R_2$ and $R_3$ each represents —O—$R_{10}$, —S—$R_{10}$, an acylamino group or an aliphatic group; $R_4$ represents —C(=O)—$R_{11}$ or a heterocyclic group; $R_5$ and $R_6$ each represents a hydrogen atom or a substituent group; $R_7$ and $R_9$ each represents an aliphatic group, an aliphatic oxy group, an aryl group or an aryloxy group; $R_8$ represents an aliphatic group or an aryl group; $R_{10}$ represents an aliphatic group or —C(=O)—$R_7$; and $R_{11}$ represents a substituted hydrazino group or a heterocyclic group.

21 Claims, No Drawings

SILVER HALIDE COLOR PHOTOGRAPHIC MATERIAL

FIELD OF THE INVENTION

This invention relates to a silver halide color photographic material (hereinafter referred to simply as a photographic material), and more particularly to a photographic material which, upon processing, provides a dye image that does not fade or discolor.

BACKGROUND OF THE INVENTION

Typically, photographic materials include silver halide emulsion layers sensitive to the three primary colors of red, green and blue colors of light. A dye image is formed by three kinds of color formers (i.e., couplers) contained in the emulsion layers which are developed in relation with complementary colors to colors sensitive to these layers, respectively. Namely, a dye image is formed by subtractive color photography.

The dye image obtained by processing such photographic materials is generally composed of an azomethine dye or an indoaniline dye formed by the coupling reaction of the couplers with the oxidants of aromatic primary amine developing agents. However, the thus obtained color photographic image is not always stable against exposure to light or moisture and heat. For example, when the image is exposed to light over a long period of time, or stored under high temperature and humidity conditions, the dye image becomes faded or discolored.

The fading or discoloration of the dye image is a serious defect in recording materials. To solve this problem, the art has turned to couplers capable of providing dyes having high fastness or to color mixing inhibitors. Further, the use of ultraviolet light absorbers has been proposed to prevent the image from being deteriorated by ultraviolet light.

The use of color mixing inhibitors has been remarkably effective in preventing the image from being deteriorated. For example, hydroquinones, hindered phenols, catechols, gallic esters, aminophenols, hindered amines, chromanols, indanes, and ethers or esters obtained by silylating, acylating or alkylating the phenolic hydroxyl group of these compounds and metal complexes are conventionally added.

While these compounds have effectively prevented the dye image from being faded or discolored, they are still considered insufficient to meet the requirements of customers who require a higher image quality. Moreover, these compounds can introduce certain disadvantages. Such disadvantages include a change in hue, fogging, a failure in dispersion, and crystallite formation after the coating of the emulsions. Accordingly, on a whole, these compounds are not considered to provide excellent effects as photographic additives.

Certain phenolic compounds having a specific substituent group in the molecule as well as derivatives thereof are known as image deterioration inhibitors. Further, hydrazide compounds and hydroxylamine compounds are known as antifading agents.

These compounds can prevent fading from occurring. However, these compounds are insufficient to meet the requirements of imparting high fastness to the image. Further, some of these compounds have introduced certain disadvantages. These disadvantages include a change in hue, great coloration of white ground, color formation (hereinafter referred to as fog) in unexposed area, and the inhibition of the development of the couplers. Thus, it is clear that these compounds often have an adverse effect on photographic characteristics.

U.S. Pat. No. 4,252,893 discloses specific phenolic compounds as antifogging agents. The compounds have an antifogging effect, but do not provide a sufficient antifading effect.

SUMMARY OF THE INVENTION

An object of the present invention is to provide a photographic material which provides a color image which does not discolor over a long period of time and which has good preservability.

Another object of the present invention is to provide a photographic material containing a photographic additive which sufficiently prevents the dye image from being faded or discolored without causing a change in hue and fogging and moreover, which does not form crystallite after coating.

Still another object of the present invention is to provide a photographic material containing a photographic additive which has excellent solubility in high boiling organic solvents, etc. and does not form any crystallite before or after coating even when the amount of the high boiling organic solvent is reduced, or the amount of the photographic additive is increased and moreover, which does not have any adverse effect on either other photographic additives or the developability of the couplers.

A further object of the present invention is to provide a photographic material having good preservability and containing a photographic additive which neither fades the yellow dye image over a long period of time, nor causes coloration on the white ground (i.e., yellow stain) after a lapse of time.

The present inventors have found that the above described objects can be achieved by introducing at least one compound represented by the following general formula (A) into the photographic material.

Accordingly, the present invention provides a silver halide color photographic material which comprises a support having thereon at least one layer containing at least one compound according to the following formula (A).

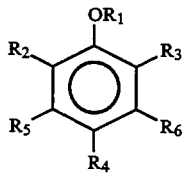

(A)

wherein $R_1$ represents a hydrogen atom, an aliphatic group, —C(=O)—$R_7$, —S(=O)$_2$—$R_8$ or —P(=O)($R_7$)($R_9$); $R_2$ and $R_3$ each represents —O—$R_{10}$, —S—$R_{10}$, an acylamino group or an aliphatic group; $R_4$ represents —C(=O)—$R_{11}$ or a heterocyclic group; $R_5$ and $R_6$ each represents a hydrogen atom or a substituent group; $R_7$ and $R_9$ each represents an aliphatic group, an aliphatic oxy group, an aryl group or an aryloxy group; $R_8$ represents an aliphatic group or an aryl group; $R_{10}$ represents an aliphatic group or —C(=O)—$R_7$; and $R_{11}$ represents a group represented by the following formula (Ap) or (Aq) or a heterocyclic group.

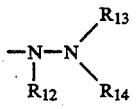

(Ap)

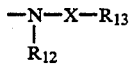

(Aq)

wherein $R_{12}$ and $R_{13}$ each represents a hydrogen atom, an aliphatic group or an aryl group; $R_{14}$ represents an acyl group, an aliphatic oxycarbonyl group, an aryloxycarbonyl group, a carbamoyl group, an aliphatic group or an aryl group; X represents an oxygen atom or a sulfur atom; or $R_{12}$ and $R_{13}$, $R_{12}$ and $R_{14}$ or $R_{13}$ and $R_{14}$ may be combined together to form a five-membered to seven-membered ring.

DETAILED DESCRIPTION OF PREFERRED EMBODIMENTS OF THE INVENTION

The present invention will be illustrated in greater detail below.

As discussed herein, when a group includes an aliphatic portion in its definition, the aliphatic portion may be straight chain, branched chain or cyclic and may be saturated or unsaturated, unless otherwise specified. For example, the aliphatic portion may be an alkyl, alkenyl, cycloalkyl or cycloalkenyl portion which may be unsubstituted or substituted. In addition, when a group has an aryl portion, the aryl portion may be monocyclic or fused ring and may be unsubstituted or substituted. Moreover, when a group has a heterocyclic portion, the heterocyclic portion includes at least one hetero-atom (e.g., nitrogen atom, sulfur atom, oxygen atom) and may be a saturated ring or an unsaturated ring and monocyclic or fused ring, and may be unsubstituted or substituted.

The term "substituent group" as used herein refers to a group which can be attached. Examples of the substituent group include an aliphatic group, an aryl group, a heterocyclic group, an acyl group, an acyloxy group, an acylamino group, an aliphatic oxy group, an aryloxy group, a heterocyclic oxy group, an aliphatic oxycarbonyl group, an aryloxycarbonyl group, a heterocyclic oxycarbonyl group, a carbamoyl group, an aliphatic sulfonyl group, an arylsulfonyl group, an aliphatic sulfonyloxy group, an arylsulfonyloxy group, a sulfamoyl group, an aliphatic sulfonamido group, an arylsulfonamido group, an amino group, an aliphatic oxycarbonylamino group, an aromatic oxycarbonylamino group, an aliphatic sulfinyl group, an arylsulfinyl group, an aliphatic thio group, an arylthio group, a mercapto group, a hydroxy group, a cyano group, a nitro group, a sulfo group, a hydroxyamino group, an aliphatic oxyamino group, an aryloxyamino group, a carbamoylamino group, a sulfamoylamino group, a halogen atom, a sulfamoylcarbamoyl group and a carbamoylsulfamoyl group.

Compounds according to formula (A) will be illustrated in greater detail below.

$R_1$ represents a hydrogen atom, an aliphatic group (preferably an alkyl group having 1 to 40 carbon atoms which may be substituted, such as methyl, ethyl, isopropyl, cyclohexyl, benzyl, dodecyl, dodecyloxyethyl, allyl), —C(=O)—$R_7$, —S(=O)$_2$—$R_8$ or —P(=C)($R_7$)($R_9$). $R_2$ and $R_3$ may be the same or different and each represents —0$R_{R10}$, —S—$R_{10}$, an acylamino group (having preferably 2 to 47 carbon atoms which may be substituted, such as acetylamino, myristoylamino, benzoylamino, phenoxyacetylamino, 4-methoxybenzoylamino) or an aliphatic group (preferably an alkyl group having 1 to 30 carbon atoms which may be substituted, such as methyl, t-butyl, isopropyl, cyclohexyl, benzyl, octyl). $R_4$ represents —C(=O)—$R_{11}$ or a heterocyclic group (preferably a five-membered to eight-membered heterocyclic group having 3 to 40 carbon atoms which may be substituted, such as morpholinyl, 1-imidazolidinyl, 1-pyrazolidinyl, succinimido). $R_5$ and $R_6$ may be the same or different and each represents a hydrogen atom or a substituent group (preferred examples of the substituent group are described above).

$R_7$ and $R_9$ each represents an aliphatic group (preferably an alkyl group having 1 to 40 carbon atoms which may be substituted, such as methyl, octyl, benzyl, t-butyl, i-propyl, cyclohexyl, dodecyloxyethyl, allyl), an aliphatic oxy group (preferably an alkoxy group having 1 to 40 carbon atoms which may be substituted, such as methoxy, hexadecyloxy, benzyloxy, cyclohexyloxy, t-octyloxy), an aryl group (having preferably 6 to 46 carbon atoms which may be substituted, such as phenyl, 4-methyoxyphenyl) or an aryloxy group (having preferably 6 to 46 carbon atoms which may be substituted, such as phenoxy, 4-dodecylphenoxy). $R_8$ represents an aliphatic group (preferably an alkyl group having 1 to 40 carbon atoms which may be substituted, such as methyl, octyl, benzyl, t-butyl, i-propyl, cyclohexyl, dodecyloxyethyl) or an aryl group (having preferably 6 to 46 carbon atoms which may be substituted, such as phenyl, 4-methoxyphenyl). $R_{10}$ represents an aliphatic group (preferably an alkyl group having 1 to 40 carbon atoms which may be substituted, such as methyl, ethyl, i-propyl, cyclohexyl, benzyl, dodecyl, dodecyloxyethyl) or —C(=O)$R_7$.

$R_{11}$ represents a group of formula (Ap) or (Aq), or a heterocyclic group. Preferably, the heterocyclic group is a five-membered to seven-membered heterocyclic group which may be substituted and has such a structure that the heterocyclic ring has 3 to 43 carbon atoms and at least one heteroatom of nitrogen atom, oxygen atom and sulfur atom as a member of the ring and may be saturated or unsaturated and the heterocyclic ring is attached to carbonyl group through nitrogen atom or carbon atom in the ring. Examples of the heterocyclic group include 4-morpholinyl, piperazinyl, 1-imidazolinyl, pyrazolidinyl, pyrazolinyl, homopiperazinyl, 2-benzimidazolyl and 1-benzimidazolyl. More preferably, the heterocyclic group is a five-membered or six-membered heterocyclic group having an additional heteroatom in the ring which is attached to carbonyl group through nitrogen atom.

$R_{12}$ and $R_{13}$ each represents a hydrogen atom, an aliphatic group (preferably an alkyl group having 1 to 40 carbon atoms which may be substituted, such as methyl, ethyl, benzyl, cyclohexyl) or an aryl group (having preferably 6 to 46 carbon atoms which may be substituted, such as phenyl, 4-methoxyphenyl).

$R_{14}$ represents an acyl group (preferably an acyl group having 2 to 47 carbon atoms which may be substituted, such as acetyl, myristoyl, benzoyl, 4-hydroxybenzoyl), an aliphatic oxycarbonyl group (preferably an alkoxycarbonyl group having 2 to 42 carbon atoms which may be substituted, such as methoxycarbonyl, octyloxycarbonyl, cyclohexyloxycarbonyl), an aryloxycarbonyl group (having preferably 7 to 47 carbon atoms which may be substituted, such as phenoxycarbonyl, 2,4-di-t-butylphenoxycarbonyl), a carbamoyl group (preferably an alkylcarbamoyl group having 2 to 47 carbon atoms or an arylcarbamoyl group having 7 to 47 carbon atoms which may be substituted such as dimethylcarbamoyl, octylcarbamoyl, benzylcarbamoyl, phenylcarbamoyl, N-methyl-N-phenylcarbamoyl), an aliphatic group (preferably an alkyl group having 1 to 40 carbon atoms which may be substituted, such as methyl, octyl, benzyl, t-butyl, i-propyl, cyclohexyl, dodecyloxyethyl), or an aryl group (having preferably 6 to 46 carbon atoms which may be substituted, such as phenyl, 4-methoxyphenyl).

X represents an oxygen atom or a sulfur atom. Alternatively, $R_{12}$ and $R_{13}$, $R_{12}$ and $R_{14}$ or $R_{13}$ and $R_{14}$ may be combined together to form a five-membered to seven-membered ring (preferably a five-membered or six-membered heterocyclic group having 3 to 43 carbon atoms which may be saturated or unsaturated and may also be substituted, such as a morpholine ring, a piperazine ring, a pyrazolidine ring, a 4-thiomorpholine-1,1-dioxide ring, a piperidine ring, a pyrrolidine ring, a pyrroline ring).

$R_1$ is preferably a hydrogen atom or an aliphatic group. More preferably, $R_1$ is a hydrogen atom. Preferably, $R_2$ and $R_3$ are each —O—$R_{10}$ or —S—$R_{10}$, and more preferably —O—$R_{10}$, wherein $R_{10}$ is preferably an aliphatic group. $R_4$ is preferably —C(=O)—$R_{11}$, wherein $R_{11}$ is preferably a group of formula (Ap), and $R_{12}$ and $R_{13}$ are each preferably a hydrogen atom or an aliphatic group, and more preferably aliphatic group. $R_{14}$ is preferably an acyl group, an aliphatic oxycarbonyl group, an aryloxycarbonyl group or an aliphatic group, and more preferably an acyl group or an aliphatic group. $R_5$ and $R_6$ are preferably a hydrogen atom.

Of the compounds of formula (A), compounds represented by the following formula (A-1) are particularly preferred.

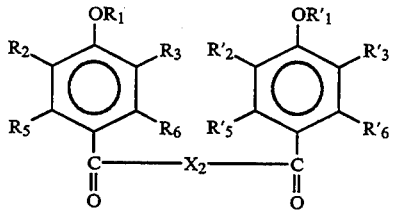

(A-1)

wherein $R_1$, $R_2$, $R_3$, $R_5$ and $R_6$ are as defined above in formula (A); $R'_1$, $R'_2$, $R'_3$, $R'_5$ and $R'_6$ have the same meaning as $R_1$, $R_2$, $R_3$, $R_5$ and $R_6$ in formula (A); and $X_2$ represents a group represented by the following formula:

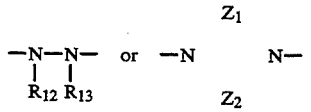

wherein $R_{12}$ and $R_{13}$ are as defined above in formula (A); and $Z_1$ and $Z_2$ each represents a nonmetallic atomic group required for forming a five-membered to seven-membered heterocyclic ring together with nitrogen atom(s).

The five-membered to seven-membered heterocyclic ring formed by $Z_1$ and $Z_2$ together with nitrogen atom(s) may be saturated or unsaturated. Examples thereof include an imidazolidine ring, a piperazine ring, a pyrazolidine ring and a homopiperazine ring. Preferably, the heterocyclic ring is a six-membered or seven-membered saturated heterocyclic ring having 4 to 20 carbon atoms which may be substituted.

Specific examples of the compounds include, but are not limited to, the following compounds.

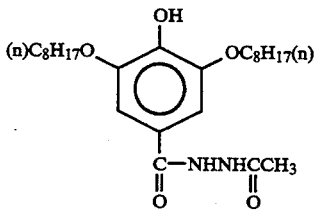

(1)

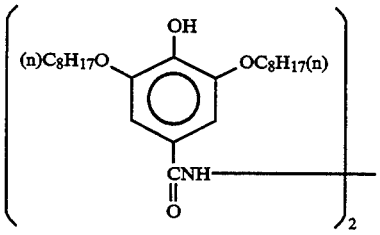

(2)

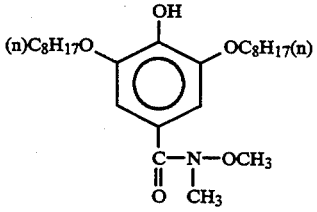

(3)

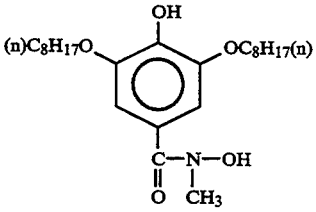

(4)

-continued
(5)
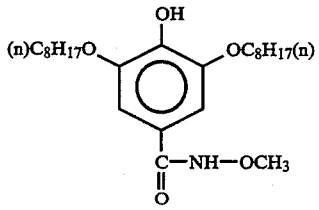
(6)
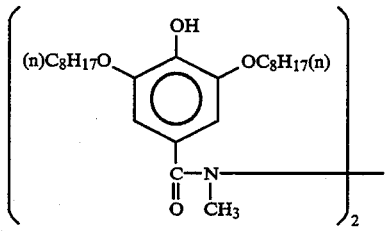
(7)
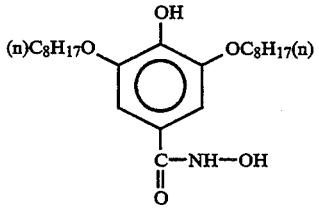
(8)
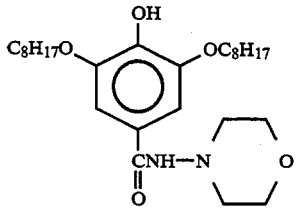
(9)
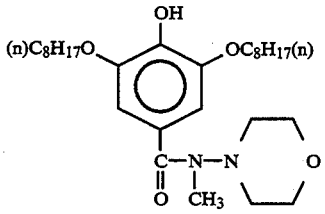
(10)
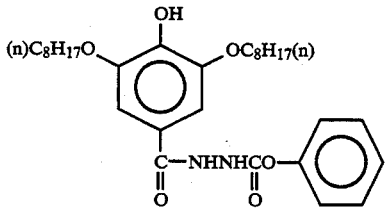
(11)
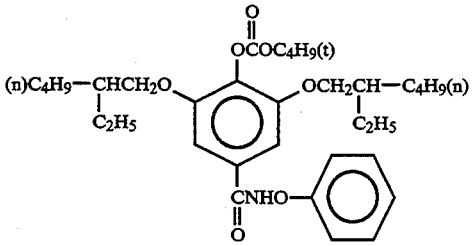
(12)
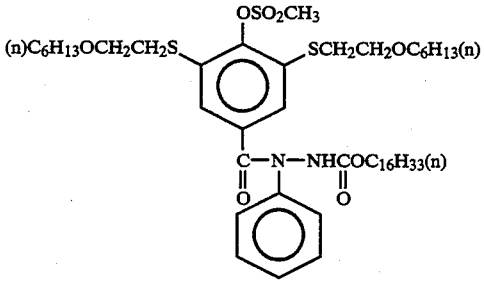
(13)
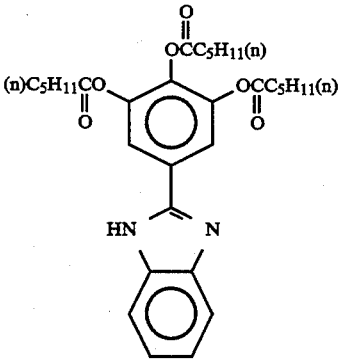
(14)
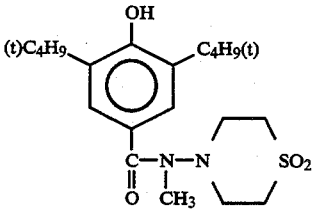

-continued
(15)
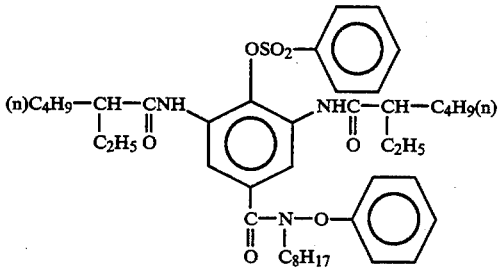
(16)
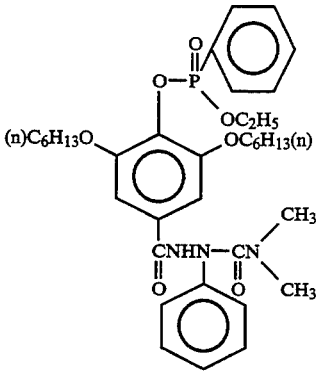
(17)
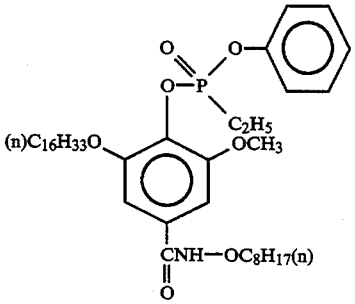
(18)
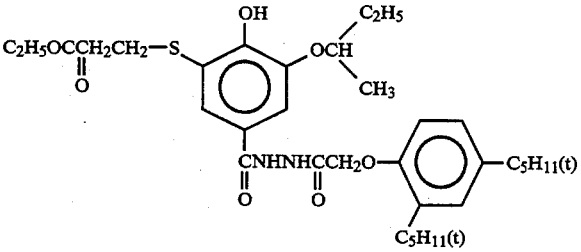
(19)
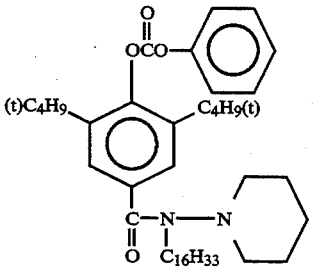
(20)
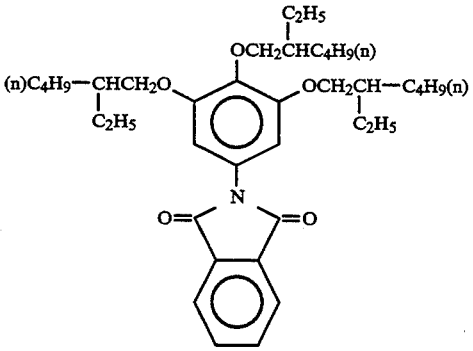
(21)
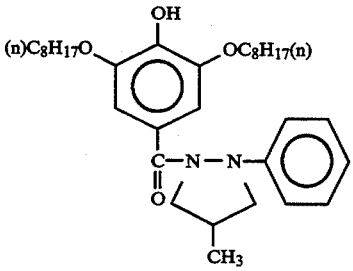
(22)
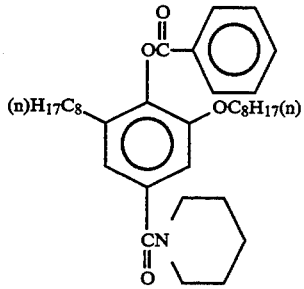

-continued
(23)
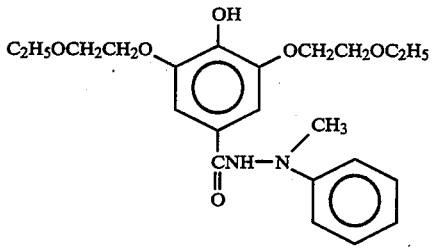
(24)
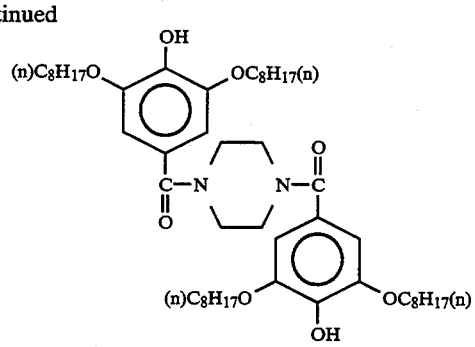
(25)
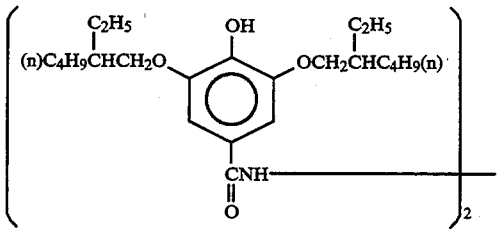
(26)
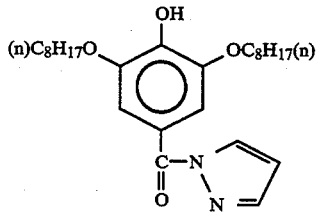
(27)
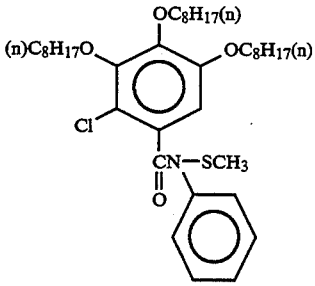
(28)
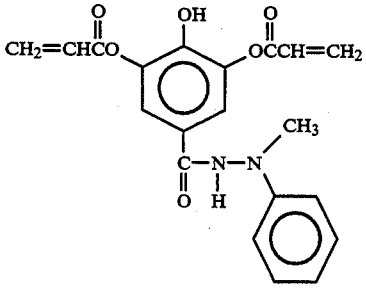
(29)
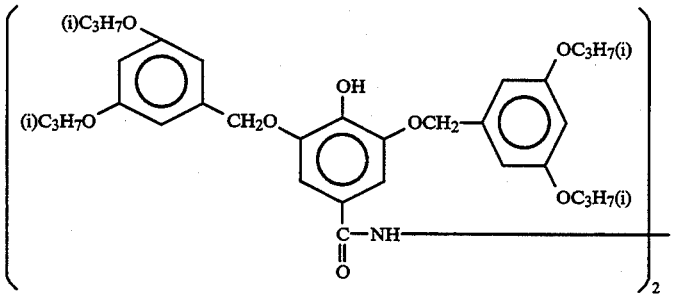
(30)
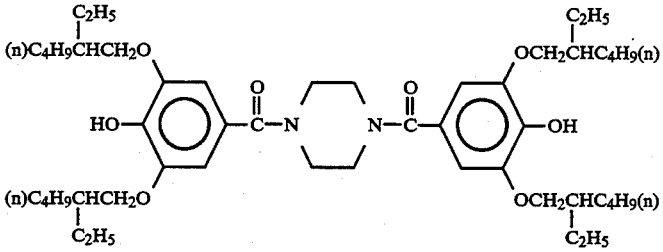
(31)
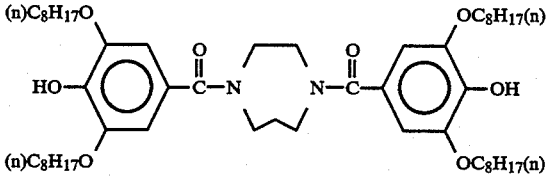
Of these, compound (6), (24), (30) or (31) is preferred.
The compounds of formula (A) used in the present invention can be synthesized by the methods described in U.S. Pat. No. 4,252,893 and JP-A-1-249739 (the term "JP-A" as used herein means an "unexamined published Japanese patent application") or referring thereto.

An example of the synthesis of a typical compound is illustrated below.

SYNTHESIS OF COMPOUND (2)

To 19.8 g of ethyl gallate, there was added 20 ml of dimethylformamide and 51.8 g of anhydrous potassium carbonate in a nitrogen gas atmosphere. While the mixture was stirred at an internal temperature of 80° to 90° C., 63.6 g of octyl bromide was added dropwise thereto over a period of 15 minutes. Further, the mixture was stirred at 90° C. for 6 hours. The resulting reaction mixture (solution) was poured into 1000 ml of cold water, and extracted with 500 ml of ethyl acetate. The ethyl acetate layer was washed with 500 ml of saturated brine twice, and the solvent was distilled off under vacuum. To the resulting oily product, there was added 20 g of potassium hydroxide and 200 ml of methanol, and the mixture was heated under reflux. The reaction mixture was poured into 300 ml of cold water containing 30 ml of concentrated hydrochloric acid, and extracted with 300 ml of ethyl acetate. The ethyl acetate layer was washed with 300 ml of saturated brine three times, and the solvent was distilled off under vacuum. The resulting oily product was crystallized from 150 ml of methanol to obtain a white crystal.

The mass spectrum, NMR spectrum and IR spectrum of the product showed that the product was the intermediate, 3,4,5-trioctyloxybenzoic acid. Yield: 43.0 g (85.0%) Melting point: 56° to 58° C.

To 10 g of 3,4,5-trioctyloxybenzoic acid, there was added 20 ml of thionyl chloride, and the mixture was heated under reflux for 3 hours. Thionyl chloride was distilled off in vacuo, and the residue was dissolved in 20 ml of methylene chloride. A solution of 2 g of hydrazine hydrate in 10 ml of dimethylacetamide was then added dropwise to the above methylene chloride solution with stirring over a period of 15 minutes. Further, the mixture was stirred for one hour, and the reaction mixture (solution) was poured into 100 ml of cold water, and extracted with 100 ml of ethyl acetate. The ethyl acetate layer was washed with 100 ml of saturated brine twice, and the solvent was distilled off under vacuum. The residue was dissolved in 20 ml of chloroform, and 8.2 ml of titanium tetrachloride was added thereto. The mixture was heated under reflux for one hour. The reaction mixture was poured into 100 ml of cold water and extracted with 100 ml of methylene chloride. The methylene chloride layer was washed with 100 ml of saturated brine twice, and the solvent was distilled off under vacuum. The resulting oily product was dissolved in 40 ml of methanol under heating, filtered through Celite and cooled. The precipitated crystal was recovered by filtration to obtain a white crystal.

The mass spectrum, NMR spectrum and IR spectrum of the product showed that the product was compound (2). Yield: 5.3 g (71.1%) with M.P. of 62° to 68° C.

The compounds of formula (A) are used in an amount of preferably 0.0002 to 20 g, more preferably 0.001 to 5 g per $m^2$ of the photographic material.

The compounds of formula (A) are introduced into at least one layer present on the support. It is preferred that the compounds of formula (A) be added to light-sensitive emulsion layers containing dye forming couplers, and it is more preferred that the compounds are co-emulsified with the dye forming couplers.

The amounts of the compounds of formula (A) to be added vary depending on the types of the couplers to be used, but are general 0.5 to 300 mol %, preferably 1 to 200 mol % based on the amount of the coupler (preferably the coupler used in the same layer).

The compounds of formula (A) may be used together with conventional color mixing inhibitors. When the compounds of formula (A) are used in combination with conventional color mixing inhibitors, an effect of preventing colors from being mixed can be further increased. Moreover, two or more of the compounds of formula (A) may be used in combination.

The above-described dye forming couplers include cyan dye forming couplers, magenta dye forming couplers and yellow dye forming couplers which form a cyan color, a magenta color and a yellow color, respectively, by the coupling reaction with the oxidants of aromatic primary amine color developing agents.

The couplers may be a four equivalent type or a two equivalent type to silver ion and may be polymer couplers or oligomer couplers. Further, these couplers may be used either alone or as a mixture of two or more thereof.

The couplers which can be preferably used in the present invention will be illustrated below.

Cyan couplers include phenol couplers and naphthol couplers. Examples of the cyan couplers which can be preferably used include those described in U.S. Pat. Nos. 4,052,212, 4,146,396, 4,228,233, 4,296,200, 2,369,929; 2,801,171; 2,772,162; 2,895,826; 3,772,002; 3,758,308; 4,334,011; and 4,327,173, West German Patent Laid-Open No. 3,329,729, European Patents 121,365A, 249,453A and 333,185A2, U.S. Pat. Nos. 3,446,622; 4,333,999; 4,775,616; 4,451,559; 4,427,767; 4,690,889; 4,254,212; and 4,296,199 and JP-A-61-42658. Further, azole couplers described in JP-A-64-553, JP-A-64-554, JP-A-64-555, JP-A-64-556 and European Patent Laid-Open Nos. 488,248; 491,197; 484,909 and 456,226, imidazole couplers described in U.S. Pat. No. 4,818,672 and JP-A-2-33144 and cyclic active methylene type cyan couplers described in JP-A-64-32260 can be used.

Particularly preferred cyan couplers include couplers of formulas (C-I) and (C-II) described in JP-A2-139544 (left lower column of page 17 to left lower column of page 20) and couplers described in European Patent Laid-Open Nos. 488,248; 491,197; 484,909; and 456,226.

Magenta couplers which can be preferably used include 5-pyrazolone compounds and pyrazoloazole compounds. Examples of the magenta couplers which can be more preferably used include those described in U.S. Pat. Nos. 4,310,619 and 4,351,897, European Patent 73,636, U.S. Pat. Nos. 3,061,432 and 3,725,067, *Research Disclosure* (RD) No. 24220 (June, 1984), JP-A-60-33552, *Research Disclosure* (RD) No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630 and WO (PCT) 88/04795.

Particularly preferred magenta couplers include pyrazoloazole magenta couplers of formula (I) described in JP-A-2-139544 (right lower column of page 3 to right lower column of page 10) and 5-pyrazolone magenta couplers of formula (M-I) described in JP-A-2-139544 (left lower column of page 17 to left upper column of page 21). Most preferred are the above-described pyrazoloazole magenta couplers.

Preferably, the compounds of formula (A) are used in combination with azole cyan or magenta couplers.

When the compounds of formula (A) are used in combination with the azole couplers, at least one member selected from the group consisting of compounds of formula (B) described in JP-A-3-233448 and compounds of formula (III) described in JP-A-3-48241 is preferably included because the effect of preventing colors from being mixed can be further increased. The amount of such compounds to be added is preferably in the range described in these patent specifications.

Typical examples of magenta and cyan couplers which can be used in the present invention include the following compounds.

(M-1)

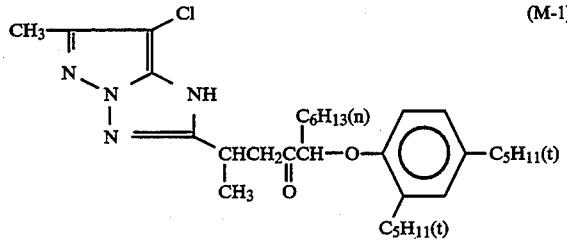

(M-2)

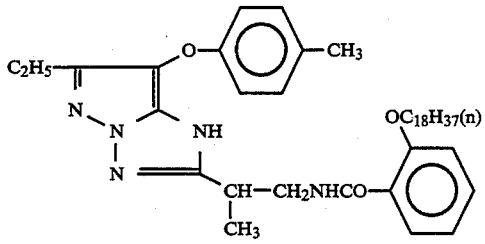

(M-3)

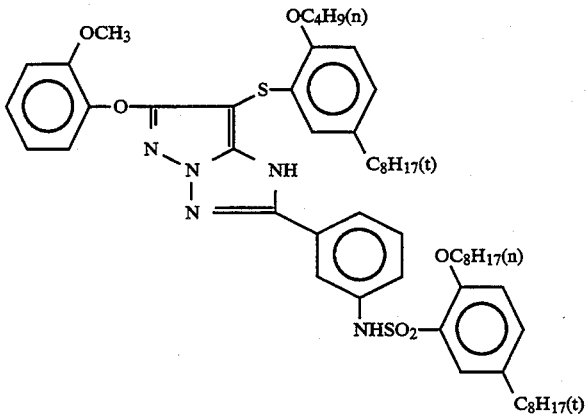

(M-4)

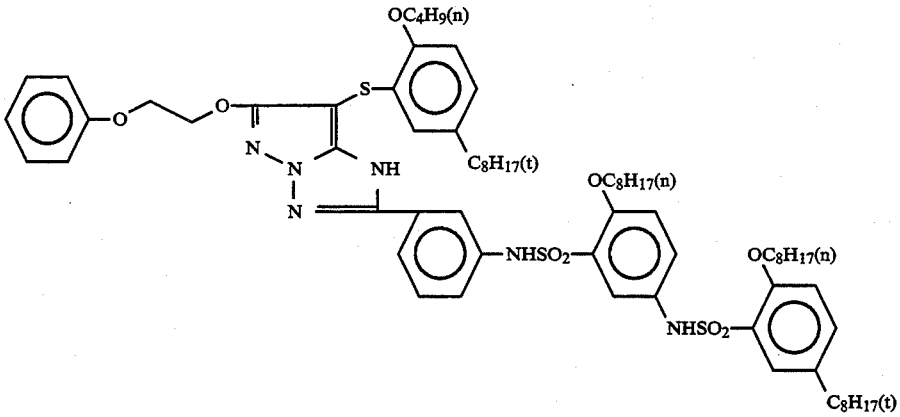

(M-5)

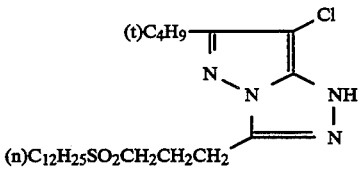

(M-6)

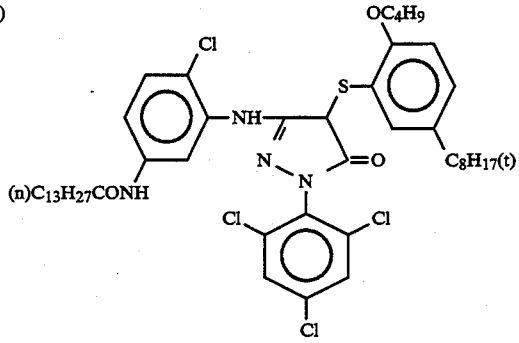

-continued
(M-7)
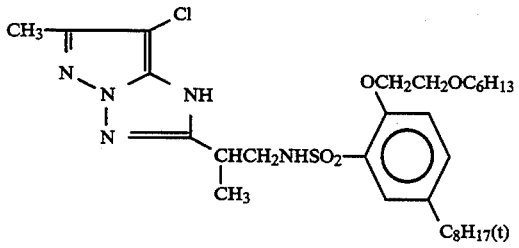
(M-8)
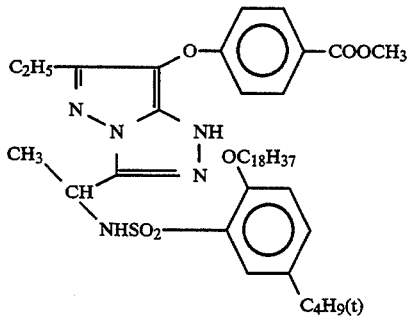
(M-9)
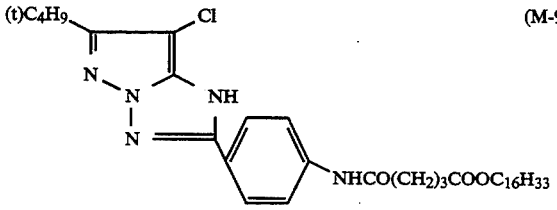
(C-1)
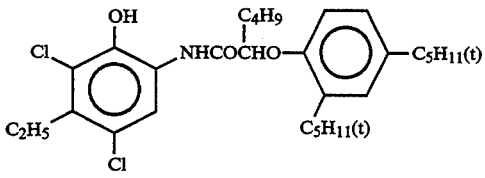
(C-2)
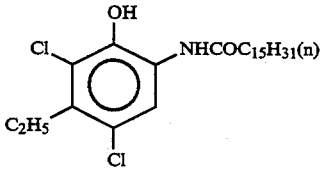
(C-3)
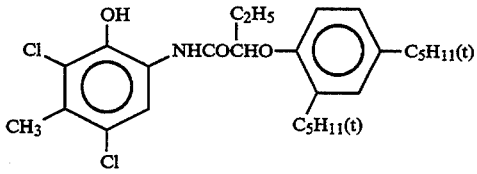
(C-4)
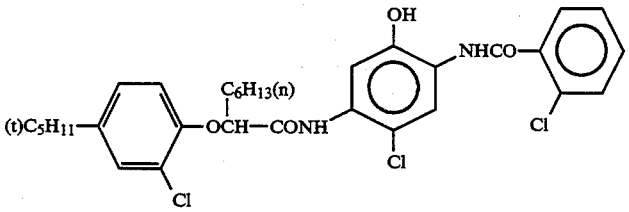
(C-5)
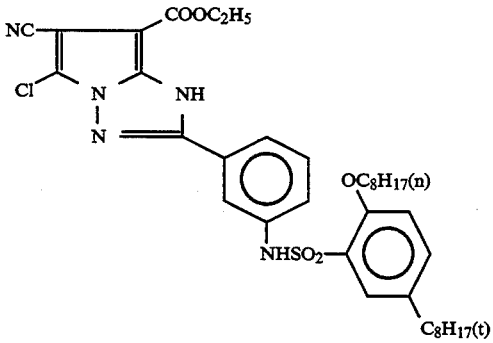
(C-6)
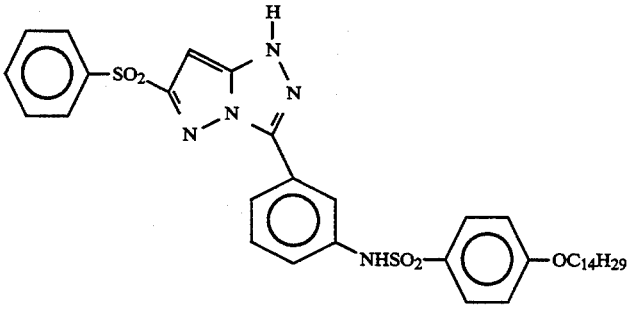

-continued (C-7)

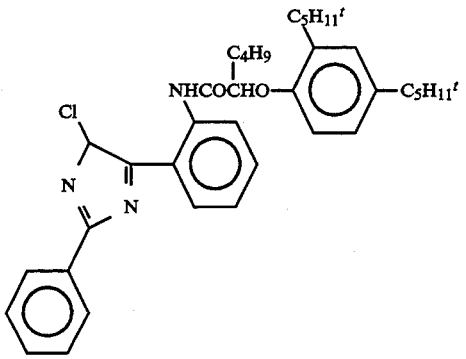

(C-8)

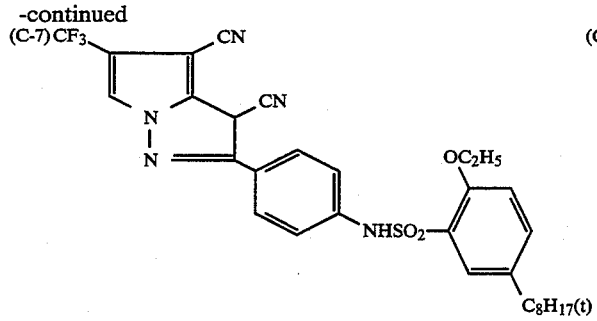

(C-9)

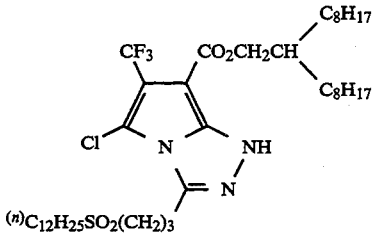

(C-10)

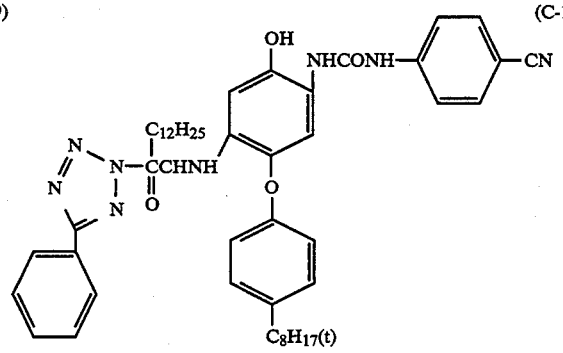

(C-11)

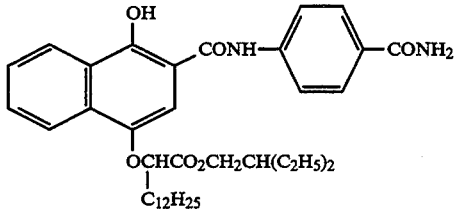

(C-12)

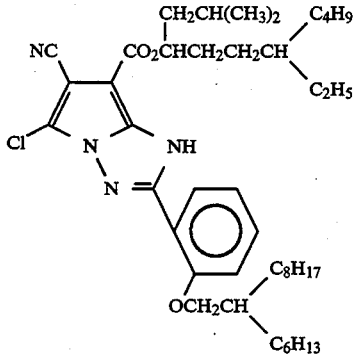

Examples of the yellow couplers which can be used include those described in U.S. Pat. Nos. 3,933,501; 4,022,620; 4,326,024; 4,401,752; 4,248,961 and 5,118,509, JP-B-58-10739 (the term "JP-B" as used herein means an "examined Japanese patent publication"), U.K. Patents 1,425,020 and 1,476,760, U.S. Pat. Nos. 3,973,968; 4,314,023; 4,511,649; and 5,118,599, European Patent 249,473A, JP-A-63-23145, JP-A-63-123047, JP-A-1-250944 and JP-A-1-213648.

It is particularly preferred that the compounds of formula (A) be co-emulsified together with yellow dye forming couplers represented by the following formula (Y).

(Y)

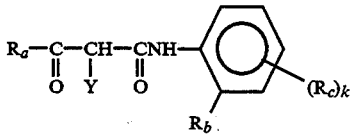

wherein $R_a$ represents an alkyl group (preferably a tertiary alkyl group having 4 to 30 carbon atoms which may have a cyclic structure and may be substituted, such as t-butyl, 1-cyclopropylethyl, 1-cyclopentylmethyl, adamantyl), an aryl group (having preferably 6 to 36 carbon atoms which may be substituted, such as phenyl, 4-methoxyphenyl), a substituted amino group (preferably an alkylamino group or an anilino group having 1 to 30 carbon atoms and which may be substituted, such as dimethylamino, dipropylamino, anilino, N-methylanilino) or a heterocyclic group (preferably a five-membered to seven-membered monocyclic or fused ring type heterocyclic group having 3 to 34 carbon atoms which may be substituted, such as piperidyl, indolinyl, tetrahydropyranyl, 3,5-dioxanyl, more preferably a five-membered or six-membered heterocyclic group attached through nitrogen atom); $R_b$ represents a halogen atom (e.g., fluorine, bromine, chlorine), an alkoxy group (having preferably 1 to 30 carbon atoms which may be substituted, such as methoxy, octadecyloxy, cyclohexyloxy, benzyloxy) or an aryloxy group (having preferably 6 to 36 carbon atoms which may be substituted, such as phenoxy, 4-methoxyphenoxy); $R_c$ represents a substituent group which can be attached to the benzene ring; Y represents a hydrogen atom or a group which can be eliminated by the coupling reaction with the oxidants of the aromatic primary amine developing agents (hereinafter referred to as eliminable group); and k represents an integer from 0 to 4 and when k is 2 or greater, two or more $R_c$ groups may be the same or different.

In formula (Y), $R_c$ is the substituent group described above. Preferred examples of the substituent group include a halogen atom, an aliphatic group having 1 to 30 carbon atoms which may be substituted, an aryl group having 6 to 36 carbon atoms which may be substituted, an aliphatic oxy group having 1 to 30 carbon atoms which may be substituted, an aliphatic oxycarbonyl group having 2 to 32 carbon atoms which may be substituted, an aryloxycarbonyl group having 7 to 37 carbon atoms which may be substituted, an acylamino group having 2 to 32 carbon atoms which may be substituted, a sulfonamido group having 1 to 30 carbon atoms which may be substituted, a carbamoyl group having 1 to 30 carbon atoms which may be substituted, a sulfamoyl group having 0 to 30 carbon atoms which may be substituted, an alkylsulfonyl group having 1 to 30 carbon atoms which may be substituted, an arylsulfonyl group having 6 to 36 carbon atoms which may be substituted, a carbamoylamino group having 1 to 30 carbon atoms which may be substituted, a sulfamoylamino group having 1 to 30 carbon atoms which may be substituted, an alkoxycarbonylamino group having 2 to 32 carbon atoms which may be substituted, a heterocyclic group having 1 to 30 carbon atoms which may be substituted, an acyl group having 2 to 32 carbon atoms which may be substituted, an alkylsulfonyloxy group having 1 to 30 carbon atoms which may be substituted and an arylsulfonyloxy group having 6 to 36 carbon atoms which may be substituted. The aliphatic moiety is preferably an alkyl, k is preferably 1 or 2 and $R_c$ is preferably attached in a para-position relative to $R_b$.

In formula (Y), Y is preferably a heterocyclic group attached to the coupling active site of the coupler through nitron atom or an aryloxy group. When Y is a heterocyclic group, Y is preferably a five-membered to seven-membered monocyclic or fused ring type heterocyclic ring having 1 to 30 carbon atoms which may be substituted such as succinimide, pyrrole, 1,2,4-triazole, imidazolidine-2,4-dione and oxazolidine-2,4-dione. When Y is an aryloxy group, Y is preferably an aryloxy group having 6 to 36 carbon atoms which may be substituted, such as 4-cyanophenoxy, 4-benzenesulfonylphenoxy, 4-propyloxycarbonylphenoxy and 2-trifluoromethylphenoxy.

It is preferred that $R_a$ be a group represented by the following formula (Ya) or (Yb).

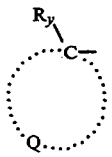

(Ya)

-continued

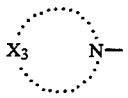

(Yb)

wherein $R_y$ is an alkyl group; Q is a nonmetallic atomic group required for forming a three-membered to five-membered hydrocarbon ring together with C or a three-membered to six-membered heterocyclic ring having at least one hetero-atom, as a member of the ring, selected from the group consisting of N, S, O and P; and $X_3$ is a nonmetallic atomic group required for forming a five-membered to eight-membered nitrogen-containing heterocyclic group; and $R_y$ is not bonded to any atom on Q.

$R_y$ is preferably methyl group, ethyl group or benzyl group, and more preferably $R_y$ is methyl group or ethyl group. Q is preferably a nonmetallic atomic group required for forming a three-membered hydrocarbon ring together with C. $X_3$ is preferably a nonmetallic atomic group required for forming a five-membered nitrogen containing heterocyclic group together with N from the standpoint of the effect of the present invention, with the case where, an optionally substituted, 1-indolinyl group is formed being more preferred.

$R_b$ is preferably chlorine atom or an alkoxy group from the standpoint of the effect of the present invention. When $R_a$ is a group of formula (Ya), chlorine atom is preferred. When $R_a$ is a group of formula (Yb), an alkoxy group is particularly preferred.

It is preferred that $R_c$ be a halogen atom, an alkoxy group, an alkoxycarbonyl group, an acylamino group, a sulfonamido group, a sulfamoyl group, an acylsulfamoyl group, a carbamoylsulfamoyl group or a sulfamoylcarbamoyl group. More preferably, $R_c$ is chlorine atom, an acylamino group, a sulfonamido group, a sulfamoyl group, an acylsulfamoyl group, a sulfamoylcarbamoyl group or a carbamoylsulfamoyl group.

The couplers of formula (Y) may be in the form of a dimer or a higher polymer where two or more members thereof are bonded to each other at the position of $R_a$, $R_b$, $R_c$ or Y through a bivalent or polyvalent group, or the couplers may be in the form of a homopolymer thereof or a copolymer comprising a non-color forming comonomer unit.

It is preferred that where $R_a$ is a group of formula (Ya) or (Yb), Y is a nitrogen containing heterocyclic group with a five-membered nitrogen containing heterocyclic group being more preferred.

Specific examples of the yellow couplers of formula (Y) include, but are not limited to, the following compounds. Further, yellow couplers of formula (I) (e.g., compounds (1) to (61)) described in European Patent 482,552A and yellow couplers of general formula (I) (e.g., compounds Y-1 to Y-78) described in European Patent 447,969A can be preferably used in the present invention.

(Y-1)
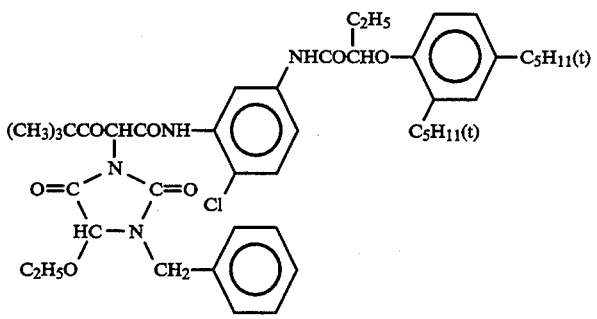
(Y-2)
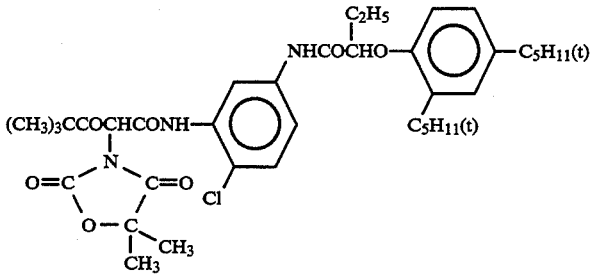
(Y-3)
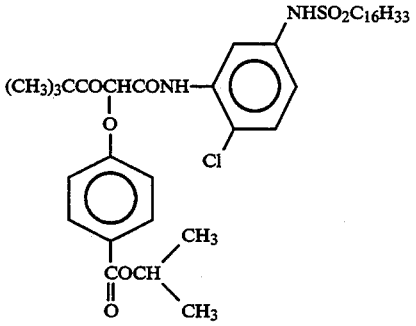
(Y-4)
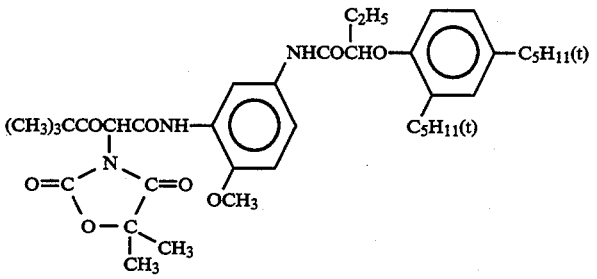
(Y-5)
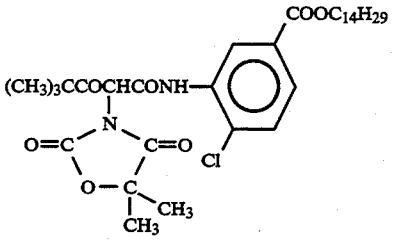

-continued
(Y-6)
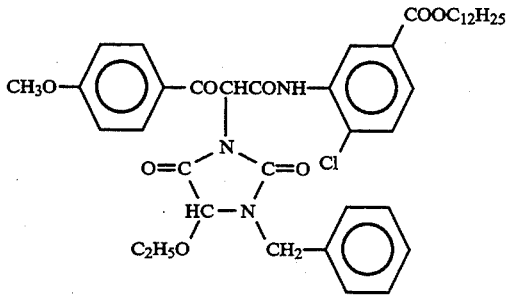
(Y-7)
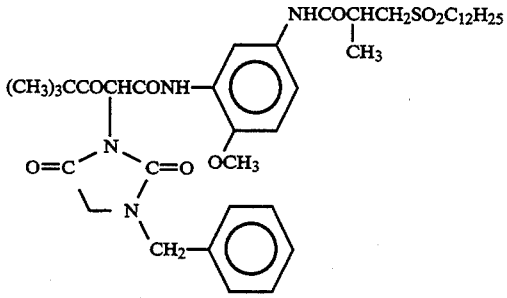
(Y-8)
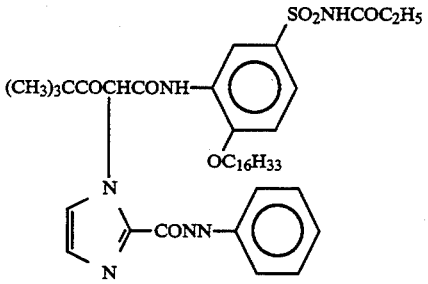
(Y-9)
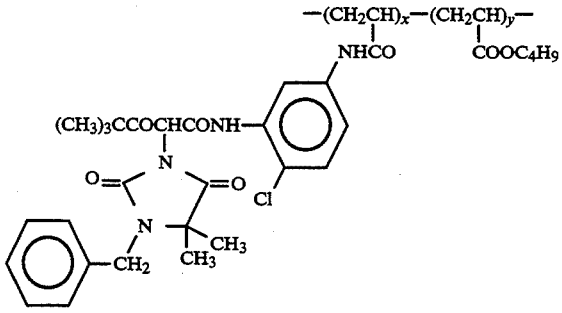
x:y = 50:50 (by weight)
Number-average MW 50,000
(Y-10)
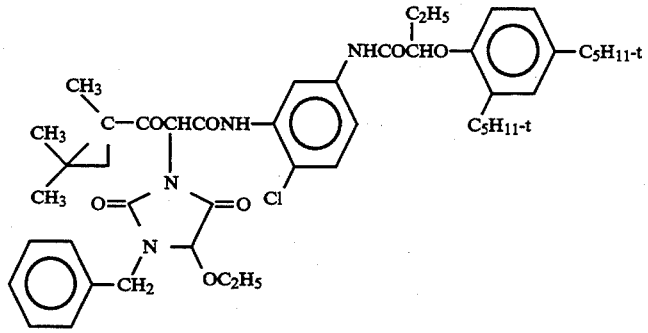

-continued
(Y-11)
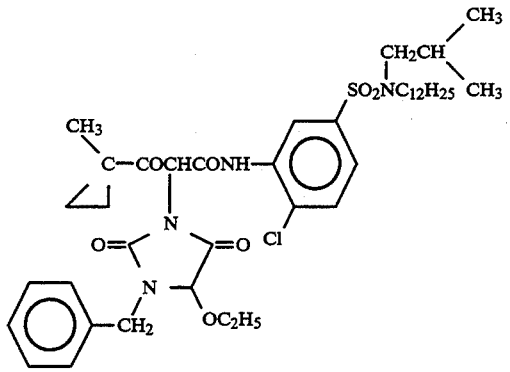
(Y-12)
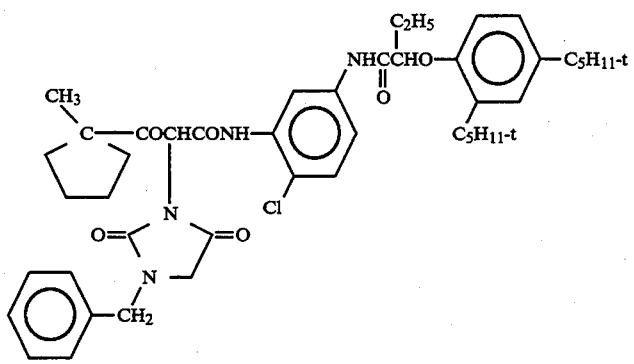
(Y-13)
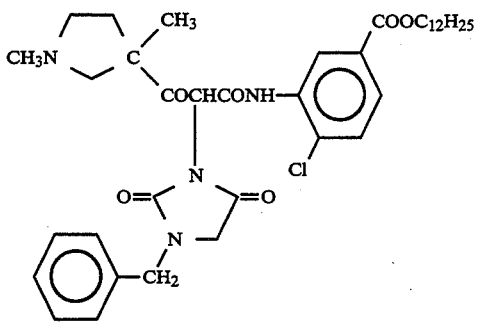
(Y-14)
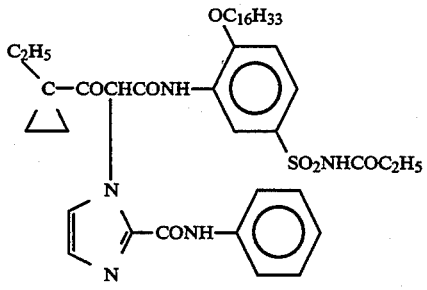
(Y-15)
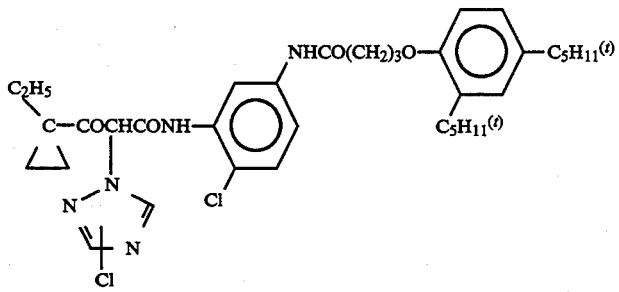

-continued
(Y-16)
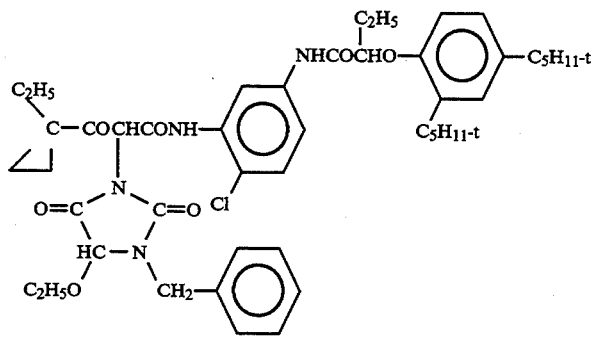
(Y-17)
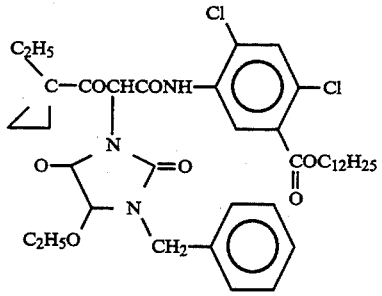
(Y-18)
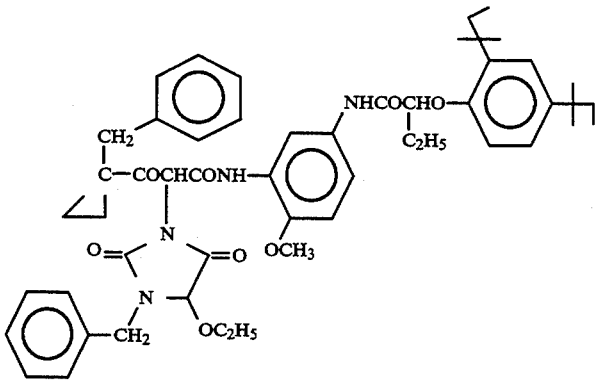
(Y-19)
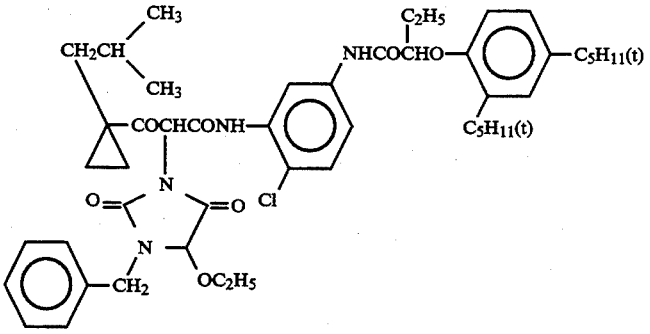

-continued
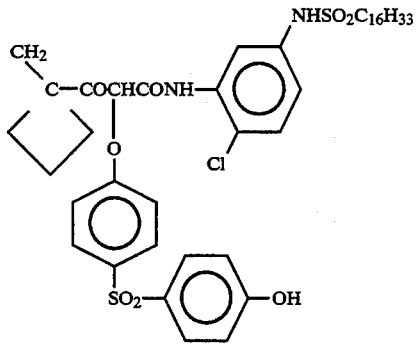
(Y-20)
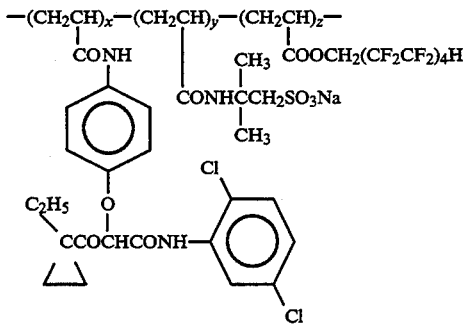
x:y:z = 50:30:20 (by weight)
Number-average MW 70,000
(Y-21)
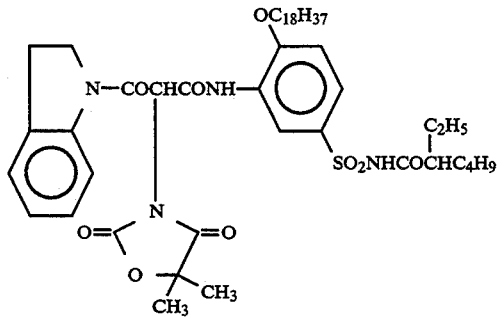
(Y-22)
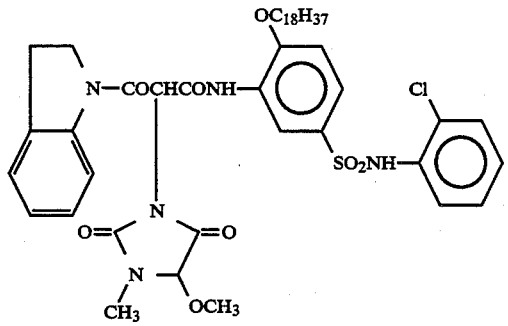
(Y-23)

-continued
(Y-24)
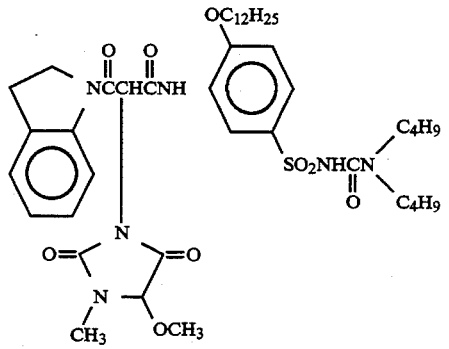
(Y-25)
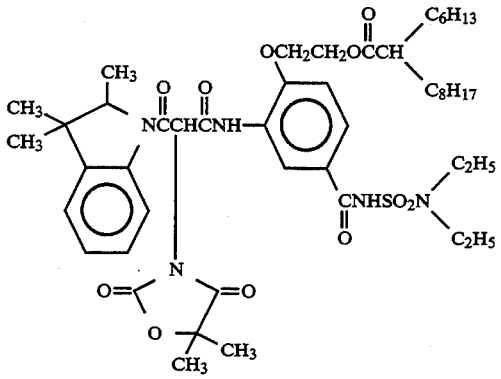
(Y-26)
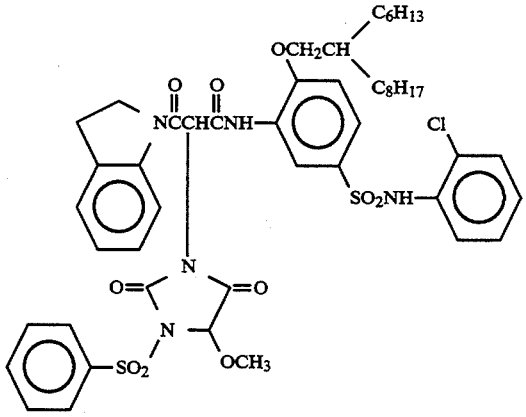
(Y-27)
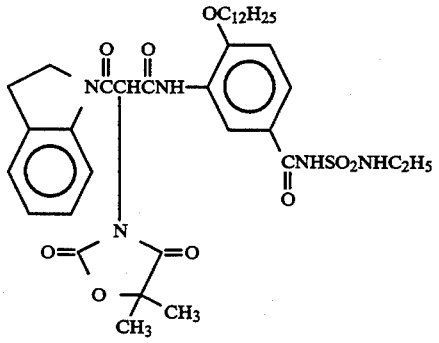

-continued
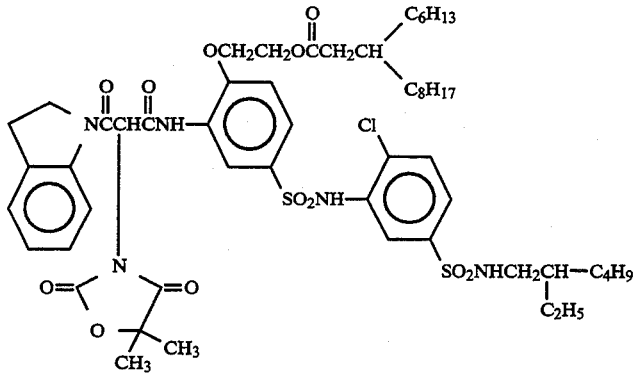
(Y-28)
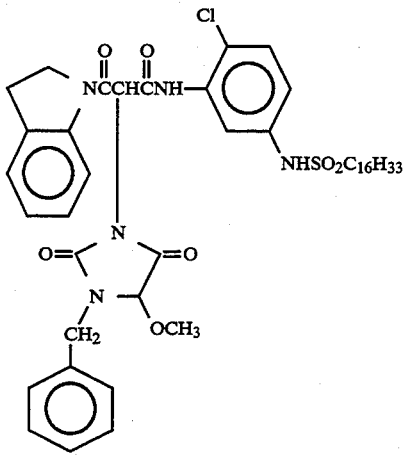
(Y-29)
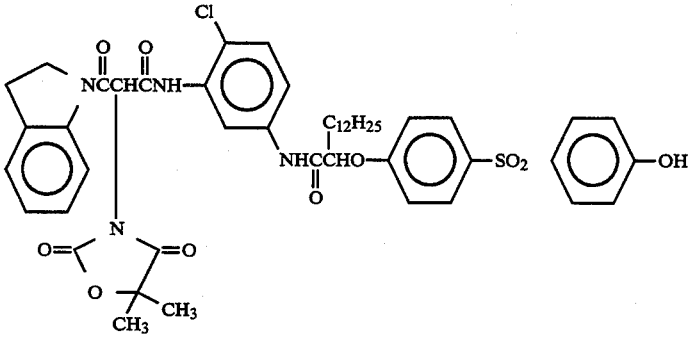
(Y-30)
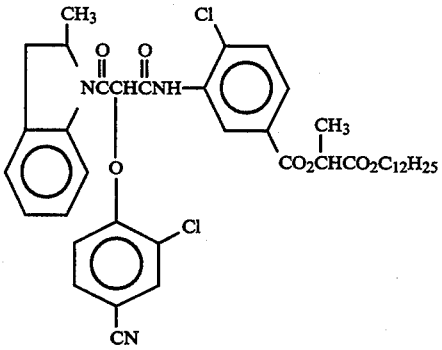
(Y-31)

-continued
(Y-32)
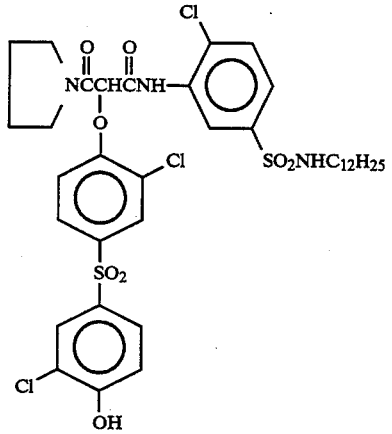
(Y-33)
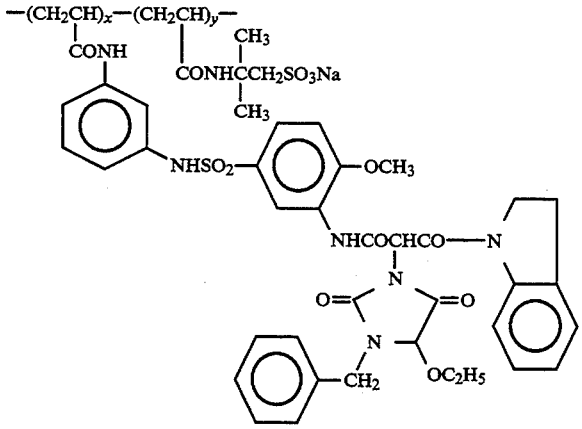
x:y = 80:20 (by weight)
Number-average MW 70,000
(Y-34)
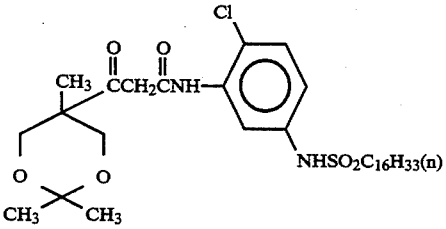
(Y-35)
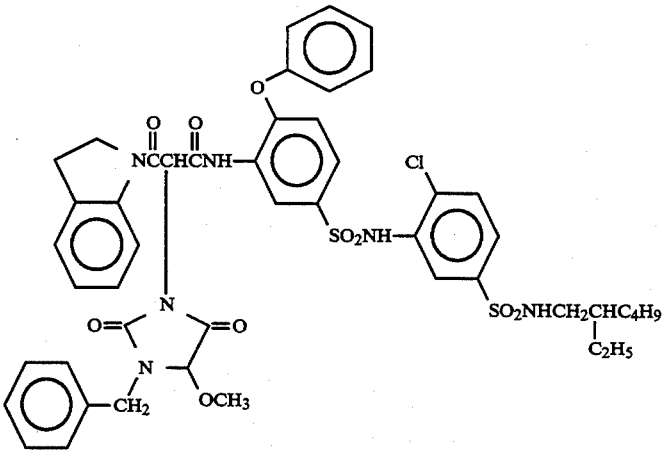
Examples of yellow couplers which can be used in the present invention in addition to the above described compounds and/or methods for synthesizing the yellow couplers are described in U.S. Pat. Nos. 3,227,554; 3,408,194; 3,894,875; 3,933,501; 3,973,968; 4,022,620;

4,057,432; 4,115,121; 4,203,768; 4,248,961; 4,266,019; 4,314,023; 4,327,175; 4,401,752; 4,404,274; 4,420,556; 4,711,837 and 4,729,944, European Patents 30,747A, 284,081A, 296,793A, 313,308A, 447,969A and 482,552A, West German Patent 3,107,173C, JP-A-58-42044, JP-A-59-174839, JP-A-62-276547 and JP-A-63-123047.

Couplers which release a photographically useful residue upon coupling can be used in the present invention. Preferred examples of DIR couplers which release a restrainer include those described in the patent specifications cited in the aforesaid RD No. 17643, item VII-F, JP-A-57-151944, JP-A-57-154234, JP-A-60-184248, JP-A-63-37346, and U.S. Patents 4,248,962 and 4,782,012.

Preferred examples of couplers which release imagewise a nucleating agent or a development accelerator during development include those described in U.K. Patents 2,097,140 and 2,131,188, JP-A-59-157638 and JP-A-59-170840.

Examples of other couplers which can be used in the photographic materials of the present invention include competitive couplers described in U.S. Pat. No. 4,130,427; poly-equivalent couplers described in U.S. Pat. Nos. 4,283,472; 4,338,393 and 4,310,618; DIR redox compound releasing couplers, DIR coupler releasing couplers, DIR coupler releasing redox compounds and DIR redox releasing redox compounds described in JP-A-60-185950 and JP-A-62-24252; couplers which release a dye whose color is restored to the original one after elimination as described in European Patent 173,302A; bleaching accelerator releasing couplers described in RD No. 11449, RD No. 24241, and JP-A-61-201247; ligand releasing couplers described in U.S. Pat. No. 4,553,477; leuco dye releasing couplers described in JP-A-63-75747; and fluorescent dye releasing couplers described in U.S. Pat. No. 4,774,181.

The yellow couplers are typically used in an amount of 0.001 to 1 mol, preferably 0.01 to 0.5 mol, per mol of light-sensitive silver halide in the same layer.

The above color couplers which can be used in the present invention are typically used in an amount of 0.001 to 1 mol per mol of light-sensitive silver halide in the same layer. Preferably, the yellow couplers are used in an amount of 0.01 to 0.5 mol, the magenta couplers are used in an amount of 0.003 to 0.3 mol, and the cyan couplers are used in an amount of 0.002 to 0.3 mol per mol of silver halide.

The compounds of formula (A) and the couplers can be introduced into the photographic materials by various conventional dispersion methods. Oil-in-water dispersion methods are preferred. In such a method, they are dissolved in a high boiling organic solvent (optionally together with a low boiling organic solvent), the resulting solution is emulsified and dispersed in an aqueous gelatin and the resulting dispersion is added to the silver halide emulsion.

Examples of the high boiling organic solvent used in such oil-in-water dispersion methods are described in U.S. Pat. No. 2,322,027. Specific examples of the stages and effects of latex dispersion methods as a type of polymer dispersion methods and impregnating latexes are described in U.S. Pat. No. 4,199,363, West German Patent Laid-Open (OLS) Nos. 2,541,274 and 2,541,230, JP-B-53-41091 and European Patent Laid-Open No. 029,104. Dispersion methods using organic solvent-soluble polymers are described in WO (PCT) 88/00723.

Examples of the high boiling organic solvent which can be used in the oil-in-water dispersion methods include phthalic esters (e.g., dibutyl phthalate, dioctyl phthalate, dicyclohexyl phthalate, di-2-ethylhexyl phthalate, decyl phthalate, bis(2,4-di-t-amylphenyl) isophthalate, bis(1,1-diethylpropyl) phthalate), phosphoric or phosphonic esters (e.g., diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridecyl phosphate, di-2-ethylhexyl phenyl phosphate), benzoic esters (e.g., 2-ethylhexyl benzoate, 2,4-dichlorobenzoate, dodecyl benzoate, 2-ethylhexyl p-hydroxybenzoate), amides (e.g., N,N-diethyldodecaneamide, N,N-diethyllaurylamide), alcohols or phenols (e.g., isostearyl alcohol, 2,4-di-t-amylphenol), aliphatic esters (e.g., dibutoxyethyl succinate, di-2-ethylhexylsuccinate, 2-hexyldecyl tetradecanoate, tributyl citrate), aniline derivatives (e.g., N,N-dibutyl-2-butoxy-5-t-octylaniline), chlorinated paraffins (e.g., paraffins having a chlorine content of 10 to 80%), trimesic esters (e.g., tributyl ester of trimesic acid), dodecylbenzene, diisopropylnaphthalene, phenols (e.g., 2,4-di-t-amylphenol, 4-dodecyloxyphenol, 4-dodecyloxycarbonylphenol, 4-(4-dodecyloxyphenolsulfonyl)phenol), carboxylic acids (e.g., 2-(2,4-di-t-amylphenoxybutyric acid, 2-ethoxyoctanedecanoic acid) and alkylphosphoric acids (e.g., di-2-ethylhexylphosphoric acid, diphenylphosphoric acid). Organic solvents having a boiling point of not lower than 30° C., but not higher than about 160° C. (e.g., ethyl acetate, butyl acetate, ethyl propionate, methyl ethyl ketone, cyclohexanone, 2-ethoxyethyl acetate, dimethylformaldehyde) may be used as co-solvents.

The high boiling organic solvents are used in an amount of 0 to 10.0 times, preferably 0 to 5.0 times, more preferably 0 to 1.0 time by weight the amount of coupler.

The photographic materials of the present invention may contain various anti-fading agents in addition to the compounds of formula (A). Typical examples of organic anti-fading agents for cyan, magenta and/or yellow images include hydroquinones, 6-hydroxychromans, 5-hydroxycoumarans, spiro-chromans, hindered phenols such as bisphenols and p-alkoxyphenols, gallic acid derivatives, methylenedioxybenzenes, aminophenols, hindered amines and ethers and ester derivatives obtained by silylating or alkylating the phenolic hydroxyl group of these compounds. Further, metal complexes such as typically (bissalicyl-aldoximato)nickel complex and (bis-N,N-dialkyldithiocarbamato)nickel can also be used.

Specific examples of the organic antifading agents include hydroquinones described in U.S. Pat. Nos. 2,360,290; 2,418,613; 2,700,453; 2,701,197; 2,728,659; 2,732,300; 2,735,765; 3,982,944 and 4,430,425, U.K. Patent 1,363,921 and U.S. Pat. Nos. 2,710,801 and 2,816,028; 6-hydroxychromans, 5-hydroxycoumarans and spiro-chromans described in U.S. Pat. Nos. 3,432,300; 3,573,050; 3,574,627; 3,698,909 and 3,764,337 and JP-A-52-152225; spiro-indanes described in U.S. Pat. No. 4,360,589; p-alkoxyphenols described in U.S. Pat. No. 2,735,765, U.K. Patent 2,066,975, JP-A-59-10539 and JP-B-57-19765, hindered phenols described in U.S. Pat. Nos. 3,700,455 and 4,228,235, JP-A-52-72224 and JP-B-52-6623; gallic acid derivatives described in U.S. Pat. No. 3,457,079; methylenedioxybenzenes described in U.S. Pat. No. 4,332,886; aminophenols described in JP-B-56-21144; hindered amines described in U.S. Pat. Nos. 3,336,135 and 4,268,593, U.K.

Patents 1,326,889, 1,354,313 and 1,410,846, JP-B-51-1420, JP-A-58-114036, JP-A-59-53846 and JP-A-59-78344; metal complexes described in U.S. Pat. Nos. 4,050,938 and 4,241,155 and U.K. Patent 2,027,731 (A).

These compounds are used in an amount of usually 5 to 100% by weight based on the amount of the corresponding coupler. These compounds can be co-emulsified with the couplers and added to the light-sensitive layers.

The photographic materials of the present invention may contain hydroquinone derivatives, aminophenol derivatives, gallic acid derivatives and ascorbic acid derivatives as color fogging inhibitors (antifogging agents). It is preferred that an ultraviolet light absorber be introduced into the cyan color forming layer and both layers adjacent thereto to prevent the cyan color image from being deteriorated by heat and, particularly, light.

Examples of the ultraviolet light absorbers include aryl group-substituted benztriazole compounds (e.g., those described in U.S. Pat. No. 3,533,794); 4-thiazolidone compounds (e.g., those described in U.S. Pat. Nos. 3,314,794 and 3,352,681); benzophenone compounds (e.g., those described in JP-A-46-2784); cinnamic ester compounds (e.g., those described in U.S. Pat. Nos. 3,705,805 and 3,707,395); butadiene compounds (e.g., those described in U.S. Pat. No. 4,045,229); triazine compounds (e.g., those described in JP-A-46-3335); and benzoxazole compounds (e.g., those described in U.S. Pat. Nos. 3,406,070 and 4,271,307). If desired, ultraviolet light absorbing couplers (e.g., α-naphthol cyan dye forming couplers) and ultraviolet light absorbing polymers may be used. These ultraviolet light absorbers may be modanted in a specific layer. Of these compounds, the aryl group-substituted benztriazole compounds are preferred.

It is preferred that the photographic materials of the present invention contain dye image preservability improving compounds such as those described in European Patent Laid-Open No. 0,277,589A2 together with the couplers, particularly pyrazoloazole magenta couplers.

Namely, a compound (A) described in European Patent Laid-Open No. 0,277,589A2 and/or a compound (B) described in European Patent Laid-Open No. 0,277,589A2 can be used, the compound (A) being chemically bonded to the aromatic amine color developing agent left behind after color development to form a compound which is chemically inert and substantially colorless, and the compound (B) being chemically bonded to the oxidant of the aromatic amine color developing agent left behind after color development to form a compound which is chemically inert and substantially colorless. The use of these compounds can prevent stain from being formed from a developed dye produced by the reaction of the couplers with the color developing agent or the oxidant thereof left behind after processing, as well as prevent other undesirable side effects from occurring.

It is preferred that antifungal agents as described in JP-A-63-271247 be added to the photographic materials of the present invention to prevent the image from being deteriorated by the growth of bacteria and fungi in the hydrophilic colloid layers.

Silver halides which can be used in the present invention include silver chloride, silver bromide, silver chlorobromide, silver iodochlorobromide and silver iodobromide. However, silver chlorobromide containing substantially no silver iodide and having a silver chloride content of preferably at least 90 mol %, more preferably at least 95 mol %, particularly preferably at least 98 mol % or pure silver chloride emulsion is preferred for the purpose of rapid processing.

It is further preferred that dyes which can be decolorized by processing (particularly oxonol dyes) described in European Patent Laid-Open No. 0,337,490A2 (pages 27 to 76) be added to the hydrophilic colloid layers of the photographic materials in such an amount as to give an optical density of at least 0.70 at 680 nm to improve the sharpness, etc. of the image.

Alternatively, at least 12 wt. % (more preferably at least 14 wt. %) of titanium oxide having a surface treated with a bivalent to tetravalent alcohol such as trimethylol ethane can be introduced into the water-resistant resin layer of the support to improve the sharpness etc. of the image.

Examples of the display support which can be used in the present invention include white polyester supports and supports having a layer containing a white pigment on the silver halide emulsion layer side thereof. It is preferred that an antihalation layer be coated on the silver halide layer coated side of the support or on the back side thereof to improve sharpness. It is particularly preferred that the transmission density of the support is set to from 0.35 to 0.8 so as to be enjoyed by reflected light as well as transmitted light.

The photographic materials of the present invention may be exposed to visible light or infrared light. Exposure may include low illumination exposure and high illumination short time exposure. Particularly, in the latter case, laser scanning exposure system where the exposure time is shorter than $10^{-4}$ sec per one pixel is preferred.

It is also preferred that a band and a stop filter described in U.S. Pat. No. 4,880,726 are used in conducting exposure whereby light stain can be removed and color reproducibility can be greatly improved.

It is preferred that the present invention be applied to photographic materials containing no developing agent (paraphenylenediamine derivatives) before processing. For example, the present invention can be preferably applied to color paper, color photographic materials (e.g., color paper, reversal color paper) and color photographic materials which form a positive image (e.g., direct positive color photographic materials, color positive films, reversal color films). It is particularly preferred that the present invention is applied to color photographic materials having a reflection support.

The photographic materials of the present invention can be processed by conventional methods described in the aforesaid RD No. 17643 (pages 28 to 29) and RD No. 18716 (left column to right column of page 615). For example, a color development stage, a desilverization stage and a rinsing stage can be carried out. In the desilverization stage, a blix stage using a blix solution may be carried out instead of conducting separately a bleaching stage using a bleaching solution and a fixing stage using a fixing solution. The bleaching stage, the fixing stage and the blix stage may be combined in any order. A stabilizing stage may be carried out in place of the rinsing stage. The stabilizing stage may be carried out after the rinsing stage. A monobath processing stage using a monobath developing, bleaching, fixer wherein color development, bleaching and fixing are carried out in one bath can be used. In combination with these stages, a pre-hardening stage and a neutralization stage therefor, a stop fixing stage, an after-hardening stage, a compensating stage and an intensification stage may be used.

An intermediate rinsing stage may be optionally provided between these stages. In these processing, so-called activator processing stage may be used in place of the color development stage.

Silver halide emulsions, other materials (e.g., additives, etc.), photographic constituent layers (e.g., layer arrangement, etc.), processing methods and processing additives described in the following patent specifications, particularly European Patent Laid-Open No. 0,355,660A2 can be preferably applied to the present invention.

| Photographic constituent element, etc. | JP-A-62-215272 | JP-A-2-33144 | EP0,355,660A2 |
|---|---|---|---|
| Silver halide emulsion | The 6th line of right upper column of page 10 to the 5th line of left lower column of page 12; and the 4th line from the bottom of right upper column of page 12 to the 17th line of left upper column of page 13 | The 16th line of right upper column of page 28 to the 11th line of right lower column of page 29; and the 2nd line to the 5th line of page 30 | The 53rd line of page 45 to the 3rd line of page 47; and the 20th line to the 22nd line of page 47 |
| Solvent for silver halide | The 6th line to the 14th line of left lower column of page 12; and the 3rd line from the bottom of left upper column of page 13 to the bottom of left lower column of page 18 | — | — |
| Chemical sensitizing agent | The 3rd line from the bottom of left lower column of page 12 to the 5th line from the bottom of right lower column of page 12; and the first line of right lower column of page 18 to the 9th line from the bottom of right upper column of page 22 | The 12th line to the bottom of right lower column of page 29 | The 4th line to the 9th line of page 47 |
| Spectral sensitizing agent (spectral sensitizing method) | The 8th line from the bottom of right upper column of page 22 to the bottom of page 38 | The first line to the 13th line of left upper column of page 30 | The 10th line to the 15th line of page 47 |
| Emulsion stabilizer | The first line of left upper column of page 39 to the bottom of right upper column of page 72 | The 14th line of left upper column of page 30 to the first line of right upper column of page 30 | The 10th line to the 15th line of page 47 |
| Development accelerator | The first line of left lower column of page 72 to the 3rd line of right upper column of page 91 | — | — |
| Color coupler (cyan, magenta and yellow couplers) | The 4th line of right upper column of page 91 to the 6th line of left upper column of page 121 | The 14th line of right upper column of page 3 to the bottom of left upper column of page 18; and the 6th line of right upper column of page 30 to the 11th line of right lower column of page 35 | The 15th line to the 27th line of page 4; the 30th line of page 5 to the bottom of page 28; the 29th line to the 31st line of page 45; and the 23rd line of page 47 to the 50th line of page 63 |
| Supersensitizing agent | The 7th line of left upper column of page 121 to the first line of right upper column of page 125 | — | — |
| Ultraviolet light absorber | The 2nd line of right upper column of page 125 to the bottom of left lower column of page 127 | The 14th line of right lower column of page 37 to the 11th line of left upper column of page 38 | The 22nd line to the 31st line of page 65 |
| Anti-fading agent (image stabilizing method) | The first line of right lower column of page 127 to the 8th line of left lower column of page 137 | The 12th line of right upper column of page 36 to the 19th line of left upper column of page 37 | The 30th line of page 4 to the 23rd line of page 5; the first line of page 29 to the 25th line of page 45; the 33rd line to the 40th line of page 45; and the 2nd line to the 21st line of page 65 |
| High-boiling and/or low-boiling organic solvent | The 9th line of left lower column of page 137 to the bottom of right upper column of page 144 | The 14th line of right lower column of page 35 to the 4th line from the bottom of left upper column of page 36 | The first line to the 51st line of page 64 |
| Dispersion method of photographic additive | The first line of left lower column of page 144 to the 7th line of right upper column of page 146 | The 10th line of right lower column of page 27 to the bottom of left upper column of page 28; and the 12th line of right lower column of page 35 to the 7th line of right upper column of page 36 | The 51st line of page 63 to the 56th line of page 64 |
| Hardening agent | The 8th line of right upper column of page 146 to the 4th line of left lower column of page 155 | — | — |
| Developing agent precursor | The 5th line of left lower column of page 155 to the 2nd line of right lower column of page 155 | — | — |
| Restrainer releasing compound | The 3rd line to the 9th line of right lower column of page 155 | — | — |
| Support | The 19th line of right lower column of page 155 to the 14th line of left upper column of page 156 | The 18th line of right upper column of page 38 to the 3rd line of left upper column of page 39 | The 29th line of page 66 to the 13th line of page 67 |
| Layer structure | The 15th line of left upper column of page 156 to the 14th line of right lower column of page 156 | The first line to the 15th line of right upper column of page 28 | The 41st line to the 52nd line of page 45 |
| Dye | The 15th line of right lower column | The 12th line of left upper column | The 18th line to the 22nd line of |

-continued

| Photographic constituent element, etc. | JP-A-62-215272 | JP-A-2-33144 | EP0,355,660A2 |
|---|---|---|---|
| | of page 156 to the bottom of right lower column of page 184 | of page 38 to the 7th line of right upper column of page 38 | page 66 |
| Color mixing inhibitor | The 1st line of left upper column of page 185 to the 3rd line of right lower column of page 188 | The 8th line to the 11th line of right upper column of page 36 | The 57th line of page 64 to the 1st line of page 65 |
| Gradation controller | The 4th line to the 8th line of right lower column of page 188 | — | — |
| Stain inhibitor | The 9th line of right lower column of page 188 to the 10th line of right lower column of page 193 | The bottom of left upper column of page 37 to the 13th line of right lower column of page 37 | The 32nd line of page 65 to the 17th line of page 66 |
| Surfactant | The first line of left lower column of page 201 to the bottom of right upper column of page 210 | The first line of right upper column of page 18 to the bottom of right lower column of page 24; and the 10th line from the bottom of left lower column of page 27 to the 9th line of right lower column of page 27 | — |
| Fluorine-containing compound (antistatic agent, coating aid, lubricant, anti-sticking agent) | The first line of left lower column of page 210 to the 5th line of left lower column of page 222 | The first line of left upper column of page 25 to the 9th line of right lower column of page 27 | — |
| Binder (hydrophilic colloid) | The 6th line of left lower column of page 222 to the bottom of left upper column of page 225 | The 8th line to the 18th line of right upper column of page 38 | The 23rd line to the 28th line of page 66 |
| Thickener | The first line of right upper column of page 225 to the 2nd line of right upper column of page 227 | — | — |
| Antistatic agent | The 3rd line of right upper column of page 227 to the first line of left upper column of page 230 | — | — |
| Polymer latex | The 2nd line of left upper column of page 230 to the bottom of page 239 | — | — |
| Matting agent | The first line of left upper column of page 240 to the bottom of right upper column of page 240 | — | — |
| Photographic processing method (processing stages, additives, etc.) | The 7th line of right upper column of page 3 to the 5th line of right upper column of page 10 | The 4th line of left upper column of page 39 to the bottom of left upper column of page 42 | The 14th line of page 67 to the 28th line of page 69 |

Note: The above-cited places of JP-A-62-215272 include the amendment dated March 16, 1987 which is attached to the end of the publication.
Among the above-described color couplers, short wave type yellow couplers described in JP-A-63-231451, JP-A-63-123047, JP-A-63-241547, JP-A-1-173499, JP-A-1-213648, and JP-A-1-250944 can be preferably used as yellow couplers.

The present invention is now illustrated in greater detail by reference to the following examples which, however, should not be construed as limiting the invention in any way.

EXAMPLE 1

To 16.1 g of yellow coupler (Y-1), there was added 16.1 g of high boiling organic solvent dibutyl phthalate. Further, 24 ml of ethyl acetate was added thereto to dissolve them. The resulting solution was emulsified and dispersed in 200 g of a 10 wt. % aqueous gelatin solution containing 1.5 g of sodium dodecylbenzenesulfonate.

The entire amount of the emulsified dispersion was added to 247 g of a high silver chloride emulsion (silver content: 70.0 g/kg of the emulsion, silver bromide content: 0.5 mol %). The emulsion was coated on a triacetate film base having a subbing layer in such an amount as to give a coating weight of 1.73 g/m$^2$ in terms of silver. A gelatin layer as a protective layer was provided on the coated layer in such an amount as to give a dry thickness of 1.0$\mu$ to prepare a sample 101. Sodium salt of 1-oxy-3,5-dichloro-s-triazine was used as the hardening agent for gelatin.

Samples 102 to 133 were prepared in the same manner as in the preparation of the sample 101 except that a combination of the coupler and the dye image stabilizer (in an amount of 100 mol % based on the amount of the coupler) shown in Table A below was used in the preparation of the emulsified dispersion, and the resulting emulsion was coated in the same manner as in the sample 101.

The samples were exposed to light through an optical wedge and processed in the following stages.

| Processing Stage | Temp. (°C.) | Time (sec) |
|---|---|---|
| Color Development | 35 | 45 |
| Blix | 35 | 45 |
| Rinse (1) | 35 | 30 |
| Rinse (2) | 35 | 30 |
| Rinse (3) | 35 | 30 |
| Drying | 80 | 60 |

Rinsing was carried out by the three tank countercurrent system of from Rinse (3) to Rinse (1).

The processing solutions had the following compositions.

| Color Developing Solution | |
|---|---|
| Water | 800 ml |
| Ethylenediaminetetraacetic Acid | 3.0 g |
| Disodium Salt of 4,5-Dihydroxybenzene-1,3-disulfonic Acid | 0.5 g |
| Triethanolamine | 12.0 g |
| Potassium Chloride | 2.5 g |

-continued

| | |
|---|---|
| Potassium Bromide | 0.01 g |
| Potassium Carbonate | 27.0 g |
| Fluorescent Brightener (WHITEX 4B, a product of Sumitomo Chemical Co., Ltd.) | 1.0 g |
| Sodium Sulfite | 0.1 g |
| Disodium Salt of N,N-Bis(sulfonatoethyl) hydroxylamine | 5.0 g |
| N-Ethyl-N-(β-methanesulfonamidoethyl)-3-methyl-4-aminoaniline 3/2 sulfate monohydrate | 5.0 g |
| Water to make | 1000 ml |
| pH (at 25° C. adjusted with potassium hydroxide and sulfuric acid) | 10.05 |
| Blix Solution | |
| Water | 600 ml |
| Ammonium Thiosulfate (700 g/l) | 100 ml |
| Ammonium Ethylenediaminetetraacetato Ferrate | 55 g |
| Ethylenediaminetetraacetic Acid | 5 g |
| Ammonium Bromide | 40 g |
| Nitric Acid (67%) | 30 g |
| Water to make | 1000 ml |

-continued

| | |
|---|---|
| pH (at 25° C. adjusted with acetic acid and ammonia water) | 5.8 |
| Rinsing Solution | |
| Sodium Chlorinated Isocyanurate | 0.02 g |
| Deionized Water (electrical conductivity: 5 μs/cm or below) | 1000 ml |
| pH | 6.5 |

Each of the samples having a dye image formed thereon was exposed to light for 8 days by using a xenon tester (illuminance: 200,000 1×) equipped with an ultraviolet light absorbing filter (a product of Fuji Photo Film Co., Ltd.) which cuts light having a wavelength of 400 nm or below. Evaluation was made by the residual ratio of the dye image density of each sample at an initial density of 2.0.

The measurement was made with a Fuji autographic densitometer. The results obtained are shown in Table A below.

TABLE A

| Sample | Coupler | Dye Image Stabilizer | Residual Ratio of Density of Yellow Dye Image, Xenon at 200,000 1× for 8 days, at an initial density of 2.0 (%) | Remarks |
|---|---|---|---|---|
| 101 | Y-1 | — | 42 | Comp. Ex. |
| 102 | " | Comparative compound (a) | 45 | " |
| 103 | " | Comparative compound (b) | 48 | " |
| 104 | " | Comparative compound (c) | 50 | " |
| 105 | " | Comparative compound (d) | 60 | " |
| 106 | " | (1) | 79 | Invention |
| 107 | " | (3) | 75 | " |
| 108 | " | (6) | 78 | " |
| 109 | " | (8) | 74 | " |
| 110 | " | (30) | 78 | " |
| 111 | Y-16 | — | 28 | Comp. Ex. |
| 112 | " | Comparative compound (a) | 32 | " |
| 113 | " | Comparative compound (b) | 35 | " |
| 114 | " | Comparative compound (c) | 52 | " |
| 115 | Y-16 | Comparative compound (d) | 50 | Comp. Ex. |
| 116 | " | (1) | 80 | Invention |
| 117 | " | (2) | 79 | " |
| 118 | " | (4) | 75 | " |
| 119 | " | (6) | 82 | " |
| 120 | " | (9) | 80 | " |
| 121 | " | (17) | 72 | " |
| 122 | " | (30) | 82 | " |
| 123 | Y-22 | — | 39 | Comp. Ex. |
| 124 | " | Comparative compound (a) | 35 | " |
| 125 | " | Comparative compound (b) | 38 | " |
| 126 | " | Comparative compound (c) | 48 | " |
| 127 | " | Comparative compound (d) | 52 | " |
| 128 | " | (1) | 83 | Invention |
| 129 | Y-22 | (2) | 82 | Invention |
| 130 | " | (4) | 76 | " |
| 131 | " | (6) | 80 | " |
| 132 | " | (10) | 70 | " |

TABLE A-continued

| Sample | Coupler | Dye Image Stabilizer | Residual Ratio of Density of Yellow Dye Image, Xenon at 200,000 1× for 8 days, at an initial density of 2.0 (%) | Remarks |
|---|---|---|---|---|
| 133 | " | (30) | 80 | " |

Comparative Compound (a) (Compound described in U.S. Pat. No. 4,252,893)

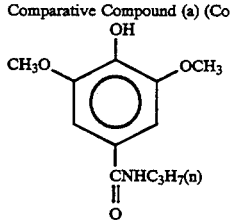

Comparative Compound (b) (Compound described in JP-B-54-12337)

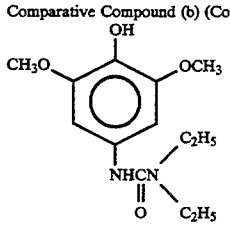

Comparative Compound (c) (Compound described in U.S. Pat. No. 4,656,125)

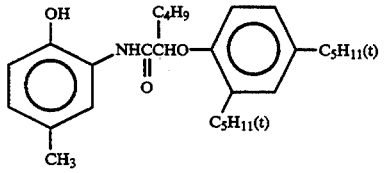

Comparative Compound (d) (Compound described in U.S. Pat. No. 5,190,853)

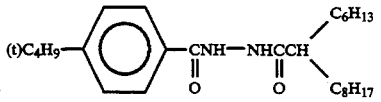

As can be seen from the results shown in Table A, the compounds of the present invention can effectively prevent fading of the dye image by light, while also provide a significant improvement in fastness. The data further confirms that such effects can not be expected from conventional phenol compounds and derivatives thereof.

Further, samples were prepared in the same manner as in Example 1 by using magenta coupler (M-1) or cyan coupler (C-5) in place of yellow coupler and using the compounds shown in Table A above. The resulting samples were subjected to the xenon fading test. It was found that the compounds of the present invention have an excellent effect.

EXAMPLE 2

Both sides of a paper support were laminated with polyethylene. The surface of the polyethylene laminated paper support was subjected to a corona discharge treatment, and a gelatin subbing layer containing sodium dodecylbenzenesulfonate was provided thereon. Further, the following photographic constituent layers were coated to prepare a multi-layer color photographic paper having the following layer structure (sample 101). Coating solutions were prepared in the following manner.

Preparation of Coating Solution for First Layer 158.0 g of yellow coupler (ExY), 15.0 g of dye image stabilizer (Cpd-1), 7.5 g of dye image stabilizer (Cpd-2) and 16.0 g of dye image stabilizer (Cpd-3) were dissolved in 25 g of solvent (Solv-1), 25 g of solvent (Solv-2) and 180 cc of ethyl acetate. The resulting solution was emulsified and dispersed in 1000 g of a 10% aqueous gelatin solution containing 60 cc of 10% sodium dodecylbenzenesulfonate and 10 g of citric acid to prepare an emulsified dispersion A. Separately, a silver chlorobromide emulsion A (cubic; 3:7 (by silver molar ratio) mixture of a larger-size emulsion A having a mean grain size of 0.88 μm and a smaller-size emulsion A having a mean grain size of 0.70 μm; a coefficient of variation in a grain size distribution being 0.08 and 0.10, respectively; 0.3 mol % of silver bromide being localized on a part of the surface of the grain in each size emulsion) was prepared. The following blue-sensitive sensitizing dyes A and B were added to the emulsion ($2.0\times10-4$ mol of each of the dyes was added to the larger-size emulsion A, and $2.5\times10^{-4}$ mol of each of the dyes was added to the smaller-size emulsion A, each amount being per mol of silver). The chemical ripening of the emulsion was carried out by adding a sulfur sensitizing agent and a gold sensitizing agent. The above emulsified dispersion A and the silver chlorobromide emulsion A were mixed and dissolved, and a coating solution for the first layer was prepared so as to give the following composition. The amount of the emulsion is represented by the coating weight in terms of silver.

Coating solutions for the second layer through the seventh layer were prepared in the same manner as in the preparation of the coating solution for the first layer. Sodium salt of 1-oxy-3,5-dichloro-s-triazine was used as the hardening agent for gelatin.

Further, Cpd-14 and Cpd-15 were added to each layer in such an amount as to give 25.0 mg/m$^2$ and 50.0 mg/m$^2$ in total, respectively.

The following spectral sensitizing agents are used for the silver chlorobromide emulsion in each photosensitive emulsion layer.

Blue-Sensitive Emulsion Layer

Sensitizing Dye A

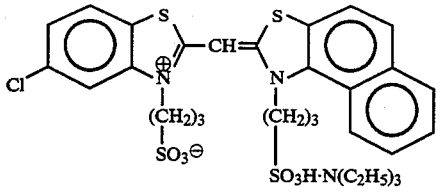

Sensitizing Dye B

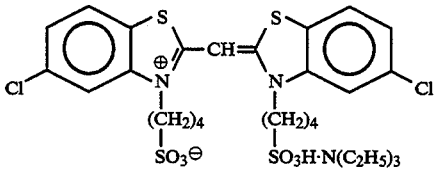

($2.0\times10^{-4}$ mol of each dye being added to the larger-size emulsion, and $2.5\times10^{-4}$ mol of each dye being added to the smaller-size emulsion, each amount being per mol of silver halide)

Green-Sensitive Emulsion Layer

Sensitizing Dye C

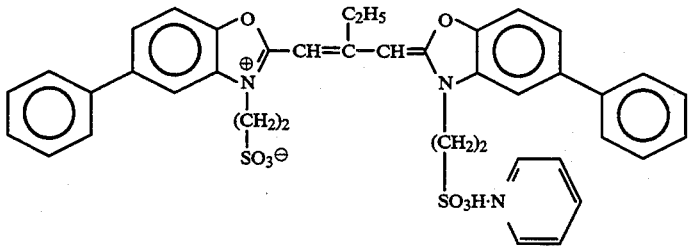

($4.0\times10^{-4}$ mol being added to the larger-size emulsion, and $5.6\times10^{-4}$ mol being added to the smaller-size emulsion, each amount being per mol of silver halide)

Sensitizing Dye D

-continued

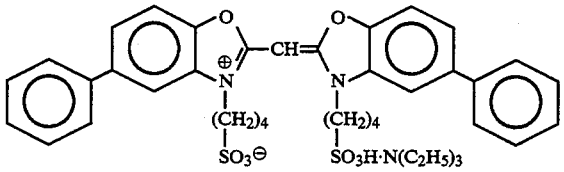

($7.0\times10^{-5}$ mol being added to the larger-size emulsion, and $1.0\times10^{-4}$ mol being added to the smaller-size emulsion, each amount being per mol of silver halide)

Red-Sensitive Emulsion Layer

Sensitizing Dye E

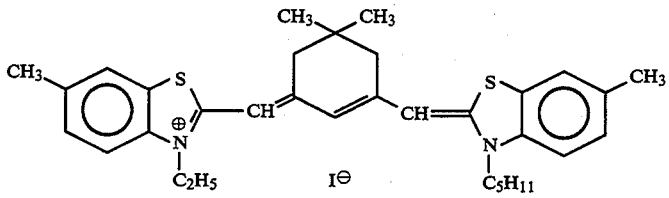

($0.9\times10^{-4}$ mol being added to the larger-size emulsion, and $1.1\times10^{-4}$ mol being added to the smaller-size emulsion, each being per mol of silver halide)

Further, $2.6\times10^{-3}$ mol of the following compound F per mol of silver halide was added to the red-sensitive emulsion layer.

Compound F

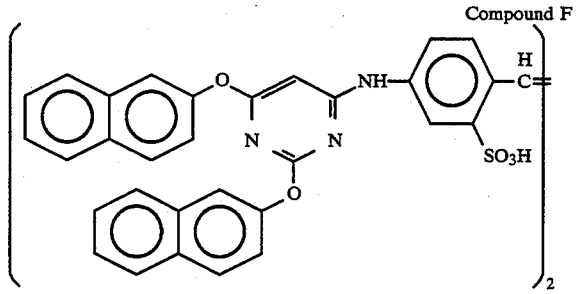

Further, $8.5\times10^{-5}$ mol, $7.7\times10^{-4}$ mol and $2.5\times10^{-4}$ mol of 1-(5-methylureidophenyl)-5-mercaptotetrazole were added to the blue-sensitive emulsion layer, the green-sensitive emulsion layer and the red-sensitive emulsion layer, respectively, each amount being per mol of silver halide. Furthermore, $1\times10^{-4}$ mol and $2\times10^{-4}$ mol of 4-hydroxy-6-methyl-1,3,3a,7-tetrazaindene were added to the blue-sensitive emulsion layer and the green-sensitive emulsion layer, respectively, each amount being per mol of silver halide.

The following dyes (parenthesized numerals represent coating weights) were added to the emulsion layers to prevent irradiation.

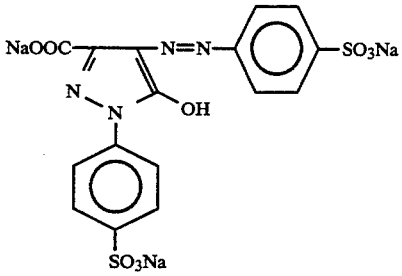

(10 mg/m²)

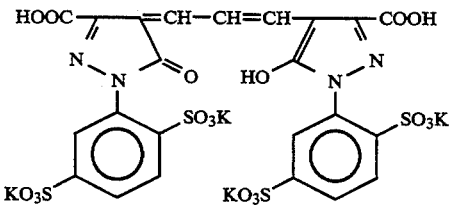

(10 mg/m²)

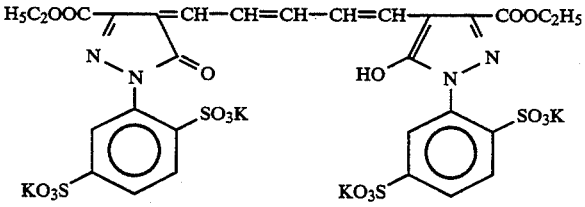

(40 mg/m²)

and

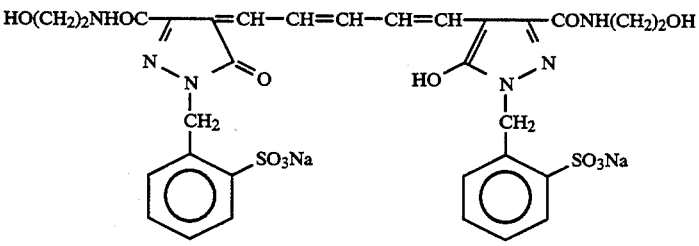

(20 mg/m²)

Layer Structure

Each layer had the following composition. Numerals represent coating weights in g/m². The amount of the silver halide emulsion is represented by a coating weight in terms of silver.

| | |
|---|---|
| Support | |
| Polyethylene-laminated Paper | |
| [Polyethylene on the first layer side contained a white pigment ($TiO_2$) and a bluish dye (ultramarine)] | |
| First Layer (blue-sensitive emulsion layer) | |
| The above Silver Chlorobromide Emulsion | 0.27 |
| Gelatin | 1.36 |
| Yellow Coupler (ExY) | 0.79 |
| Dye Image Stabilizer (Cpd-1) | 0.08 |
| Dye Image Stabilizer (Cpd-2) | 0.04 |
| Dye Image Stabilizer (Cpd-3) | 0.08 |
| Solvent (Solv-1) | 0.13 |
| Solvent (Solv-2) | 0.13 |
| Second Layer (color mixing inhibiting layer) | |
| Gelatin | 1.00 |
| Color Mixing Inhibitor (Cpd-4) | 0.06 |
| Solvent (Solv-7) | 0.03 |
| Solvent (Solv-2) | 0.25 |

-continued

| | |
|---|---|
| Solvent (Solv-3) | 0.25 |
| Third Layer (green-sensitive emulsion layer) | |
| Silver Chlorobromide Emulsion (cubic; a 1:3 (by Ag molar ratio) mixture of a larger-size emulsion B having a mean grain size of 0.55 μm and a smaller-size emulsion B having a mean grain size of 0.39 μm; a coefficient of variation in a grain size distribution being 0.10 and 0.08, respectively; 0.8 mol % of AgBr being localized on a part of the surface of the grain in each size emulsion) | 0.13 |
| Gelatin | 1.45 |
| Magenta Coupler (ExM) | 0.16 |
| Dye Image Stabilizer (Cpd-5) | 0.15 |
| Dye Image Stabilizer (Cpd-2) | 0.03 |
| Dye Image Stabilizer (Cpd-6) | 0.01 |
| Dye Image Stabilizer (Cpd-7) | 0.01 |
| Dye Image Stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (color mixing inhibiting layer) | |
| Gelatin | 0.70 |
| Color Mixing Inhibitor (Cpd-4) | 0.04 |
| Solvent (Solv-7) | 0.02 |
| Solvent (Solv-2) | 0.18 |
| Solvent (Solv-3) | 0.18 |
| Fifth Layer (red-sensitive emulsion layer) | |
| Silver Chlorobromide Emulsion (cubic; a 1:3 (by Ag molar ratio) mixture of a larger-size | 0.20 |

-continued

| | |
|---|---|
| emulsion C having a mean grain size of 0.50 μm and a smaller-size emulsion C having a mean grain size of 0.41 μm; a coefficient of variation in a grain size distribution being 0.09 and 0.11, respectively; 0.8 mol % of AgBr being localized on a part of the surface of the grain in each size emulsion) | |
| Gelatin | 0.85 |
| Cyan Coupler (ExC) | 0.33 |
| Ultraviolet Light Absorber (UV-2) | 0.18 |
| Dye Image Stabilizer (Cpd-1) | 0.30 |
| Dye Image Stabilizer (Cpd-9) | 0.01 |
| Dye Image Stabilizer (Cpd-10) | 0.01 |
| Dye Image Stabilizer (Cpd-11) | 0.01 |
| Solvent (Solv-6) | 0.22 |
| Dye Image Stabilizer (Cpd-8) | 0.01 |
| Dye Image Stabilizer (Cpd-6) | 0.01 |
| Solvent (Solv-1) | 0.01 |
| Sixth Layer (ultraviolet light absorbing layer) | |
| Gelatin | 0.55 |
| Ultraviolet Light Absorber (UV-1) | 0.38 |
| Dye Image Stabilizer (Cpd-12) | 0.15 |
| Dye Image Stabilizer (Cpd-5) | 0.02 |
| Seventh Layer (protective layer) | |
| Gelatin | 1.13 |
| Acrylic-modified Copolymer of Polyvinyl Alcohol (a degree of modification: 17%) | |
| Liquid Paraffin | 0.02 |
| Dye Image Stabilizer (Cpd-13) | 0.01 |

(ExY) Yellow Coupler

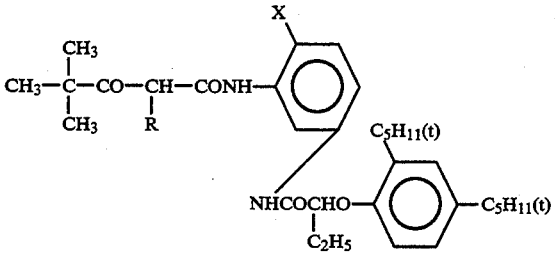

1:1 Mixture (by mol) of

R = 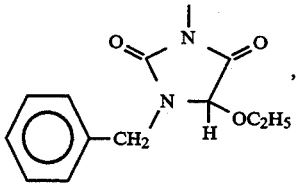 , X = Cl

R = 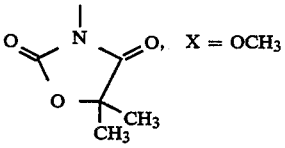 , X = $OCH_3$ (ExM) Magenta Couipler

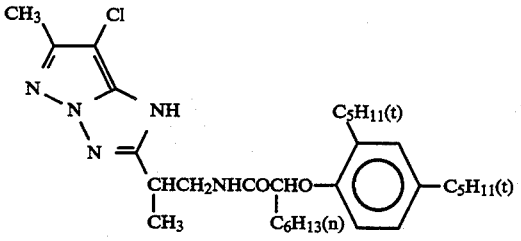

(ExC) Cyan Coupler

3:7 Mixture (by mol) of

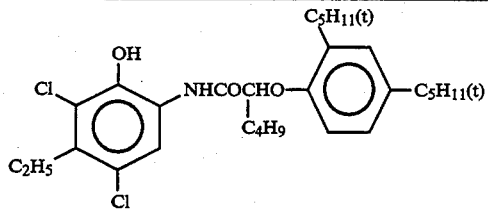

(Cpd-1) Dye Image Stabilizer

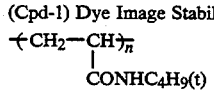

Average M.W. 60,000

(Cpd-2) Dye Image Stabilizer

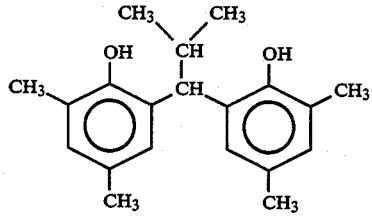

(Cpd-3) Dye Image Stabilizer

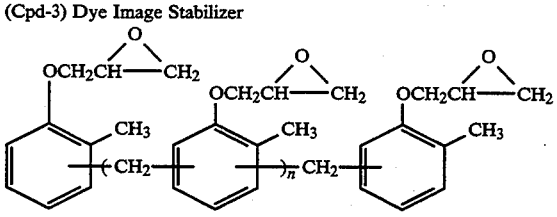

n = 7~8 (mean value)

(Cpd-4) Color Mixing Inhibitor

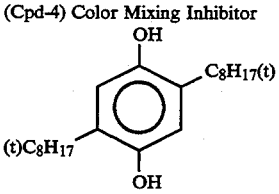

(Cpd-5) Dye Image Stabilizer

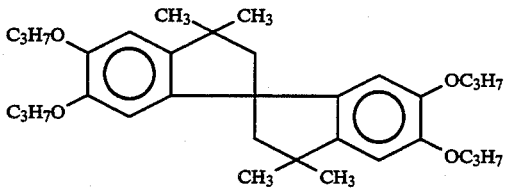

(Cpd-6) Dye Image Stabilizer

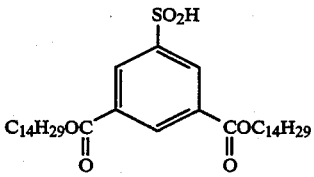

-continued (Cpd-7) Dye Image Stabilizer

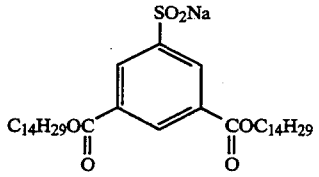

(Cpd-8) Dye Image Stabilizer

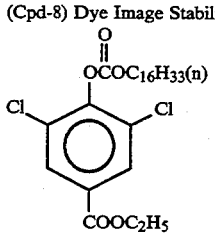

(Cpd-9) Dye Image Stabilizer

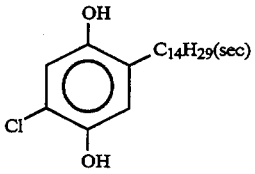

(Cpd-10) Dye Image Stabilizer

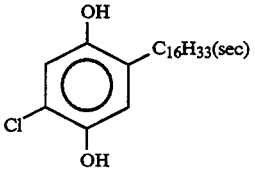

(Cpd-11) Dye Image Stabilizer

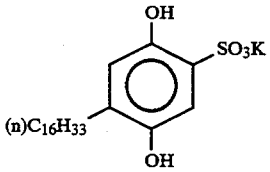

(Cpd-12) Dye Image Stabilizer

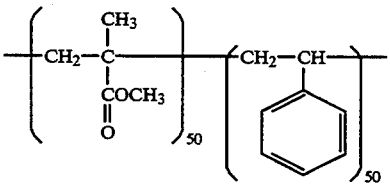

Average M.W. 60,000

(Cpd-13) Dye Image Stabilizer

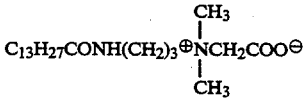

(Cpd-14) Antiseptic

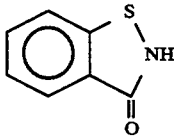

(Cpd-15) Antiseptic

-continued

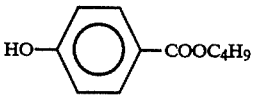

(Solv-1) Solvent

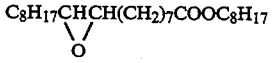

(Solv-2) Solvent

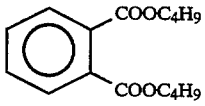

(Solv-3) Solvent

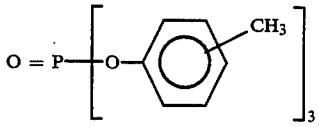

(Solv-4) Solvent

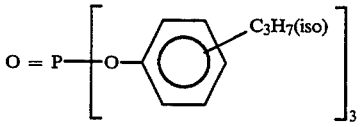

(Solv-5) Solvent

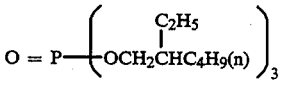

(Solv-6) Solvent

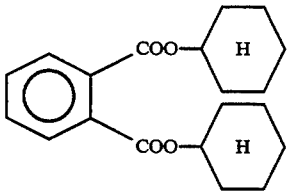

(Solv-7) Solvent

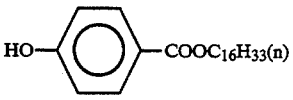

(UV-1) Ultraviolet Light Absorber
1:5:10:5 Mixture (by weight) of

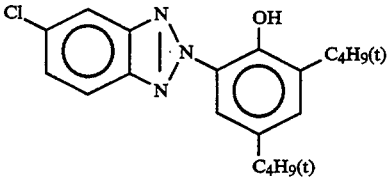

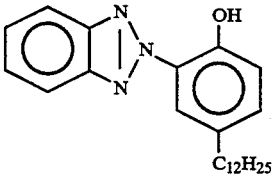

-continued

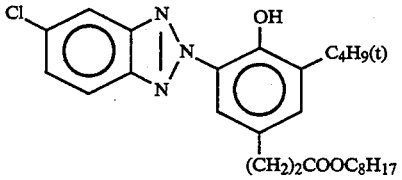

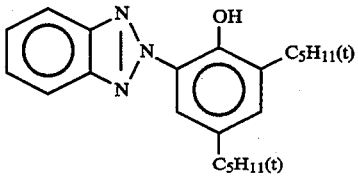

(UV-2) Ultraviolet Light Absorber
1:2:2 Mixture (by weight) of

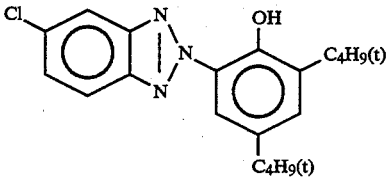

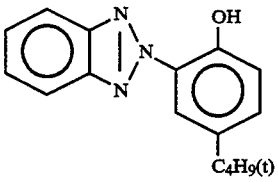

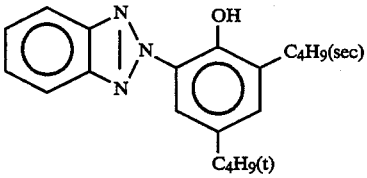

Samples 002 to 015 were prepared in the same manner as in the preparation of the sample 001 except that an equimolar amount of the yellow coupler shown in Table B below was used in place of the yellow coupler ExY, and the dye image stabilizer shown in Table B in addition to the dye image stabilizers Cpd-1, Cpd-2 and Cpd-3 was used in the first layer. The dye image stabilizer shown in Table B was used in an equimolar amount based on the amount of the yellow coupler. The same comparative compound as that used in Example 1 was used.

The sensitometer (FWH type, the color temperature of the light source: 3200° K., a product of Fuji Photo Film Co., Ltd.) was used, and the sample 001 was subjected to gray exposure to light so as to allow about 30% of the amount of coated silver to be developed.

The exposed sample was subjected to continuous processing in a paper processor by using the following processing stages and processing solutions to prepare the processed state of the running equilibrium state.

| Processing Stage | Temperature (°C.) | Time (sec) | Replenisher* (ml) | Tank Capacity (liter) |
|---|---|---|---|---|
| Color Development | 35 | 45 | 161 | 17 |
| Blix | 30 to 35 | 45 | 215 | 17 |
| Rinse | 30 | 90 | 350 | 10 |
| Drying | 70 to 80 | 60 | | |

*Replenishment rate being per $m^2$ of the photographic material.

Each processing solution had the following composition.

| Color Developing Solution | Solution | Tank Replenisher |
|---|---|---|
| Water | 800 ml | 800 ml |
| Ethylenediamine-N,N,N',N'-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-bis(carboxymethyl)hydrazine | 4.0 g | 5.0 g |
| Monosodium Salt of N,N-Di-(sulfoethyl)hydroxylamine | 4.0 g | 5.0 g |
| Fluorescent Brightener (WHITEX 4B, a product of Sumitomo Chemical Co., Ltd.) | 1.0 g | 2.0 g |
| Water to make | 1000 ml | 1000 ml |
| pH (25° C.) | 10.05 | 10.45 |

Blix Solution

Tank solution and replenisher being the same.

| | |
|---|---|
| Water | 400 ml |
| Ammonium Thiosulfate (700 g/liter) | 100 ml |
| Sodium Sulfite | 17 g |
| Ammonium Ethylenediaminetetraacetato Ferrate | 55 g |
| Disodium Ethylenediaminetetraacetate | 5 g |
| Ammonium Bromide | 40 g |
| Water to make | 1000 ml |
| pH (25° C.) | 6.0 |

Rinsing Solution

Tank solution and replenisher being the same.

Ion-exchanged water (the concentration of each of calcium ion and magnesium ion was reduced to 3 ppm or below).

The samples 001 to 015 were imagewise exposed to light through a three color separation optical wedge and processed with the above-described processing solutions.

Each of the thus-processed samples having a dye image formed thereon was subjected to a fading test. The evaluation of the effect of preventing the dye image from being faded was made by determining the residual ratio of the density of the yellow dye image at an initial density of 2.0 after exposure to light for 10 days by using the xenon tester (illuminance: 200,000 1×). The results obtained are shown in Table B below.

TABLE B

| Sample | Coupler | Dye Image Stabilizer | Residual Ratio of Density of Dye Image, Xenon at 200,000 1× for 10 days at an initial density of 2.0 | Remarks |
|---|---|---|---|---|
| 001 | ExY | — | 42 | Comp. Ex. |
| 002 | " | Comparative compound (a) | 44 | " |

TABLE B-continued

| Sample | Coupler | Dye Image Stabilizer | Residual Ratio of Density of Dye Image, Xenon at 200,000 1× for 10 days at an initial density of 2.0 | Remarks |
|---|---|---|---|---|
| 003 | " | (1) | 78 | Invention |
| 004 | " | (6) | 83 | " |
| 005 | " | (30) | 83 | " |
| 006 | Y-16 | — | 32 | Comp. Ex. |
| 007 | " | Comparative compound (a) | 35 | " |
| 008 | " | Comparative compound (d) | 45 | " |
| 009 | " | (2) | 85 | Invention |
| 010 | " | (3) | 82 | " |
| 011 | Y-22 | — | 38 | Comp. Ex. |
| 012 | " | Comparative compound (a) | 42 | " |
| 013 | " | Comparative compound (d) | 48 | " |
| 014 | " | (4) | 80 | Invention |
| 015 | " | (10) | 83 | " |

As can be seen from the results shown in Table B, the compounds of the present invention are excellent in preventing fading of the dye image by light even when the compounds of the present invention are used in the multi-layer structural photographic materials.

EXAMPLE 3

Samples 002 to 004 were prepared in the same manner as in the preparation of the sample 001 of Example 2 except that an equimolar amount of the magenta coupler shown in Table C below was used in place of the magenta coupler ExM used in the third layer of the sample 001, and an equimolar amount of the dye image stabilizer shown in Table C was used in place of the dye image stabilizer Cpd-2 used in the third layer of the sample 001. The same comparative compound as that used in Example 1 was used.

The thus-obtained samples were exposed to light, processed and subjected to the fading test (the exposure time was 10 days) in the same manner as in Example 2. Evaluation was made by the residual ratio of the density of each sample at an initial density of 0.5 and 1.0.

TABLE C

| Sample | Coupler | Dye Image Stabilizer | Residual Ratio of Density of Magenta Dye Image, Xenon at 200,000 1× for 10 days: Initial density of 0.5 | Initial density of 1.0 | Remarks |
|---|---|---|---|---|---|
| 001 | ExM | Cpd-2 | 60 | 48 | Comp. Ex. |
| 002 | " | Comparative compound (a) | 63 | 50 | " |
| 003 | " | (1) | 78 | 75 | Invention |
| 004 | " | (3) | 80 | 78 | " |

As can be seen from the results shown in Table C, the compounds of the present invention are effective in preventing the magenta dye image from being faded by light, particularly in preventing the magenta dye image in the region of low dye image density from being faded by light, and that this excellent fading inhibiting effect is not expected from conventional compounds.

EXAMPLE 4

Samples were prepared in the same manner as in the preparation of the sample 101 of Example 1 of JP-A-2-854 except that the coupler (Y-10) or (Y-23) of the present invention was used in place of the coupler used in each of the 12th layer and the 13th layer of the sample 101 of Example 1 of JP-A-2-854, and the compound (1), (5), (10), (19), (21) or (30) of the present invention in an amount of 25 mol % based on the amount of the coupler used in each of the 12th and 13th layers was co-emulsified and added in each of the 12th and 13th layers.

Further, samples were prepared in the same manner as in the preparation of the sample 101 except that the compound (10), (12), (17), (18) or (19) of the present invention was co-emulsified and added in each of the 7th, 8th and 9th layers of the sample 101, each compound being used in an amount of 25 mol % based on the amount of the coupler used in each of the 7th, 8th and 9th layers of the sample 101.

These samples were exposed to light, processed and subjected to the fading test in the same manner as in Example 1 of JP-A-2-854. It was found that each of the samples of the present invention was excellent in fastness and had good photographic characteristics.

Accordingly, it was found that the compounds of the present invention have an excellent effect even when they are used in the photographic materials of JP-A-2-854.

EXAMPLE 5

Samples were prepared in the same manner as in the preparation of the color photographic material of Example 2 of JP-A-1-158431 except that the coupler (Y-10) or (Y-23) of the present invention was used in place of the coupler used in each of the 11th and 12th layers of the color photographic material of Example of JP-A-1-158431, and an equimolar amount of the compound (5), (10), (12), (17), (19) or (30) of the present invention was used in place of Cpd-9 used in each of the 11th and 12th layers thereof.

Further, samples were prepare in the same manner as in the preparation of the color photographic material of Example 2 of JP-A-1-158431 except that an equimolar amount of the compound (2), (6), (14), (17) or (18) of the present invention was used in place of Cpd-6 used in each of the 6th and 7th layers of the color photographic material of Example 2 of JP-A-1-158431.

These samples were exposed to light and processed in the same manner as in Example 2 of JP-A-1-158431. The samples were subjected to the fading test, and the photographic characteristics thereof were examined. It was found that each of the samples of the present invention was excellent in fastness and had good photographic characteristics. Accordingly, it was found that the compounds of the present invention have an excellent effect even when they are used in the photographic materials of JP-A-1-158431.

It will be understood from the above disclosure that the compounds of general formula (A) according to the present invention have an excellent effect of improving fastness.

While the invention has been described in detail and with reference to specific embodiments thereof, it will be apparent to one skilled in the art that various changes and modifications can be made without departing from the spirit and scope thereof.

What is claimed is:

1. A silver halide color photographic material comprising a support having thereon at least one layer containing at least one compound represented by the following formula (A):

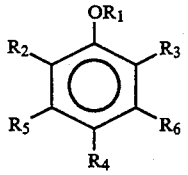

(A)

wherein $R_1$ represents a hydrogen atom, an aliphatic group, —C(=O)—$R_7$, —S(=O)$_2$—$R_8$ or —P(=O) ($R_7$) ($R_9$); $R_2$ and $R_3$ each represents —O—$R_{10}$, —S—$R_{10}$, an acylamino group or an aliphatic group; $R_4$ represents —C(=O)—$R_{11}$ or a heterocyclic group; $R_5$ and $R_6$ each represents a hydrogen atom or a substituent group; $R_7$ and $R_9$ each represents an aliphatic group, an aliphatic oxy group, an aryl group or an aryloxy group; $R_8$ represents an aliphatic group or an aryl group; $R_{10}$ represents an aliphatic group or —C(=O)—$R_7$; and $R_{11}$ represents a group represented by the following formula (Ap) or (Aq)

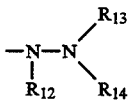

(Ap)

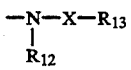

(Aq)

wherein $R_{12}$ and $R_{13}$ each represents a hydrogen atom, an aliphatic group or an aryl group; $R_{14}$ represents an acyl group, an aliphatic oxycarbonyl group, an aryloxycarbonyl group, a carbamoyl group, an aliphatic group or an aryl group; and X represents oxygen atom or sulfur atom; or $R_{12}$ and $R_{13}$, $R_{12}$ and $R_{14}$ or $R_{13}$ and $R_{14}$ may be combined together to form a five-membered to seven-membered ring.

2. The silver halide color photographic material according to claim 1, $R_1$ is a hydrogen atom or an aliphatic group.

3. The silver halide color photographic material according to claim 1, $R_1$ is a hydrogen atom.

4. The silver halide color photographic material according to claim 1, $R_2$ and $R_3$ are each —O—$R_{10}$ or —S—$R_{10}$.

5. The silver halide color photographic material according to claim 1, $R_2$ and $R_3$ are —O—$R_{10}$.

6. The silver halide color photographic material according to claim 1, $R_{10}$ is an aliphatic group.

7. The silver halide color photographic material according to claim 1, $R_4$ is —C(=O)—$R_{11}$.

8. The silver halide color photographic material according to claim 1, $R_{11}$ is a group represented by formula (Ap).

9. The silver halide color photographic material according to claim 1, $R_{12}$ and $R_{13}$ are each a hydrogen atom or an aliphatic group.

10. The silver halide color photographic material according to claim 1, $R_{12}$ and $R_{13}$ are an aliphatic group.

11. The silver halide color photographic material according to claim 1, $R_{14}$ is an acyl group, an aliphatic oxycarbonyl group, an aryloxycarbonyl group or an aliphatic group.

12. The silver halide color photographic material according to claim 1, $R_{14}$ is an acyl group or an aliphatic group.

13. The silver halide color photographic material according to claim 1, $R_5$ and $R_6$ are a hydrogen atom.

14. The silver halide color photographic material according to claim 1, the compound represented by formula (A) is used in an amount of 0.0002 to 20 g per $m^2$ of the photographic material.

15. The silver halide color photographic material according to claim 1, wherein the at least one layer further includes at least one dye forming coupler.

16. The silver halide color photographic material according to claim 15, wherein the at least one compound (A) is present in an amount of 0.5 to 300 mol % based on the amount of coupler.

17. The silver halide color photographic material according to claim 15, wherein the dye forming coupler is a yellow coupler.

18. The silver halide color photographic material according to claim 17, the yellow coupler is represented by the following formula (Y):

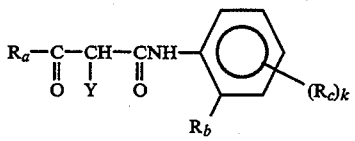

(Y)

wherein $R_a$ represents an alkyl group, an aryl group, a substituted amino group or a heterocyclic group; $R_b$ represents a halogen atom, an alkoxy group or an aryloxy group; $R_c$ represents a group which can be attached to the benzene ring; Y represents a hydrogen atom or a group which can be eliminated by the coupling reaction with the oxidant of an aromatic primary amine developing agent, and k represents an integer from 0 to 4 and if k is 2 or greater, each of the $R_c$ groups may be the same or different.

19. The silver halide color photographic material according to claim 17, the dye forming coupler is used in an amount of 0.001 to 1 mol per mol of light-sensitive silver halide in the same layer.

20. The silver halide color photographic material comprising a support having thereon at least one layer containing at least one compound selected from among those compounds presented by the following formula (A-1):

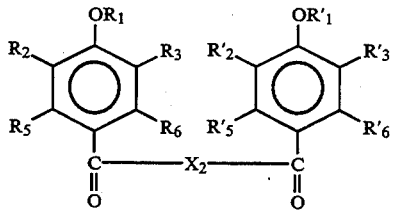

(A-1)

where $R_1$ represents a hydrogen atom, an aliphatic group, —C(=O),$R_7$, —S(=O)$_2$—R or —P(=O)($R_7$); $R_2$ and $R_3$ each represents —O—$R_{10}$, —S—$R_{10}$, an acylamino group or an aliphatic group; $R_5$ and $R_6$ each represents a hydrogen atom or a substituent group; $R_7$ and $R_9$ each represents an aliphatic group, an aliphatic oxy group, an aryl or an aryloxy group; $R_8$ represents an aliphatic group or an aryl group; $R_{10}$ represents an aliphatic group or —C(=O)—$R_7$; $R'_1$, $R'_2$, $R'_3$, $R'_5$ and $R'_6$ have the same meaning as $R_1$, $R_2$, $R_3$, $R_5$ and $R_6$, and $X_2$ is a group represented by the following formula:

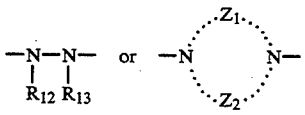

wherein $R_{12}$ and $R_{13}$ each represents a hydrogen atom, an aliphatic group or an aryl group; $Z_1$ and $Z_2$ each represents a non-metallic atomic element suitable for forming a 5-membered ring or 7-membered heterocyclic ring together with nitrogen atoms.

21. The silver halide color photographic material according to claim 20, the 5-membered to 7-membered heterocyclic ring together with nitrogen atom(s) is an imidazolidine ring, a piperazine ring, a pyrazolidine ring or a homopiperazine ring.

* * * * *